US008435716B2

(12) United States Patent
Watanabe et al.

(10) Patent No.: US 8,435,716 B2
(45) Date of Patent: May 7, 2013

(54) METHOD FOR PRODUCING TONER, TONER, AND IMAGE FORMING METHOD USING THE SAME

(75) Inventors: Masaki Watanabe, Shizuoka (JP); Osamu Uchinokura, Shizuoka (JP); Tsuneyasu Nagatomo, Shizuoka (JP); Takahiro Honda, Shizuoka (JP); Ryuta Chiba, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 142 days.

(21) Appl. No.: 13/021,236

(22) Filed: Feb. 4, 2011

(65) Prior Publication Data

US 2011/0200928 A1 Aug. 18, 2011

(30) Foreign Application Priority Data

Feb. 12, 2010 (JP) ..... 2010-029326

(51) Int. Cl.
*G03G 5/00* (2006.01)

(52) U.S. Cl.
USPC ..... 430/137.17; 430/137.1

(58) Field of Classification Search ..... 430/108.1, 430/137.1, 137.14, 137.17, 137.18
See application file for complete search history.

(56) References Cited

U.S. PATENT DOCUMENTS

| | | | | |
|---|---|---|---|---|
| 2007/0065746 | A1* | 3/2007 | Kawase et al. | 430/110.3 |
| 2007/0218390 | A1 | 9/2007 | Nozaki et al. | |
| 2008/0176159 | A1 | 7/2008 | Matsumoto et al. | |
| 2011/0033794 | A1 | 2/2011 | Watanabe et al. | |

FOREIGN PATENT DOCUMENTS

| | | | |
|---|---|---|---|
| CN | 101995783 | A | 3/2011 |
| EP | 2 282 235 | A1 | 2/2011 |
| JP | 3066943 | | 5/2000 |
| JP | 3640918 | | 1/2005 |
| JP | 4006136 | | 8/2007 |

OTHER PUBLICATIONS

Extended Search Report issued May 20, 2011 in Europe Application No. 11154140.5.
Chinese Office Action issued Mar. 16, 2012, in Chinese Patent Application No. 201110036691.7 with English translation.

* cited by examiner

*Primary Examiner* — Stewart Fraser
(74) *Attorney, Agent, or Firm* — Oblon, Spivak, McClelland, Maier & Neustadt, L.L.P.

(57) ABSTRACT

A method for producing a toner, including: dispersing toner particles containing at least a binder resin in a first aqueous medium so as to produce an aqueous dispersion; and subjecting the aqueous dispersion to heat treatment, wherein the electric conductivity of the aqueous dispersion after the heat treatment is higher than the electric conductivity of the aqueous dispersion before the heat treatment by 50 μS/cm or less.

7 Claims, 5 Drawing Sheets

METHOD FOR PRODUCING TONER, TONER, AND IMAGE FORMING METHOD USING THE SAME

BACKGROUND OF THE INVENTION

1. Field of the Invention

The present invention relates to a method for producing a toner, a toner and an image forming method using the toner.

2. Description of the Related Art

In recent years, in the field of an image forming technology based on electrophotography, increased demand has arisen for full-color image formation capable of providing images with higher image quality, and thus, developers have been designed so as to provide high-quality images. In order to cope with the demand for the improved image quality, particularly in full-color images, there is an increasing tendency toward the production of toners having smaller particle diameters, and studies have been made on faithful reproduction of latent electrostatic images. Regarding the reduction in particle diameter, a process for producing a toner by a polymerization process has been proposed as a method that can regulate the toner so as to have a desired shape and surface structure (see, for example, Japanese Patent Application Laid-Open (JP-A) Nos. 07-209952, and 2000-075551). In the toner produced by the polymerization process, in addition to the control of the diameter of toner particles, the shape of toner particles can also be controlled. A combination of this technique with a particle size reduction can improve the reproducibility of dots and thin lines, and can reduce pile height (image layer thickness), whereby an improvement in image quality can be expected. The toner generally contains a binder resin, a colorant, a charge-controlling agent and other additives.

It is considered that toner quality is largely influenced by the surface conditions of toner particles. Thus, by smoothing the surfaces of toner base particles, an external additive can exhibit its function for a long period of time, thereby achieving the improvement in transfer efficiency. The surfaces of the toner base particles are smoothed by subjecting an aqueous dispersion containing the toner particles to heat treatment, coating, or the like.

However, when the aqueous dispersion containing the toner particles is subjected to heat treatment, the electric conductivity of the aqueous dispersion increases, and the charge amount of the base particles decreases. Since the heat treatment causing adverse affect on the charging ability of the toner particles is concerned, it has been demanded that the increase of the electric conductivity of the aqueous dispersion and the decrease of the charge amount of the base particles, which are caused by heat treatment, are examined, so as to provide the conditions for suppressing adverse affect on the charging ability of the toner.

BRIEF SUMMARY OF THE INVENTION

The present invention is aimed to solve the conventional problems, and achieve the following object. Namely, an object of the present invention is to provide a toner having toner particles with smoothed surfaces obtained by subjecting an aqueous dispersion containing the toner particles to heat treatment, and having no adverse affect on the charging ability of the toner, in a full-color image forming method, and to provide the full-color image forming method using the toner.

<1> A method for producing a toner, including: dispersing toner particles containing at least a binder resin in a first aqueous medium so as to produce an aqueous dispersion; and subjecting the aqueous dispersion to heat treatment, wherein the electric conductivity of the aqueous dispersion after the heat treatment is higher than the electric conductivity of the aqueous dispersion before the heat treatment by 50 μS/cm or less.

<2> The method for producing a toner according to <1>, wherein the dispersing toner particles includes decreasing the electric conductivity of the aqueous dispersion to 30 μS/cm or less.

<3> The method for producing a toner according to any of <1> and <2>, wherein the heat treatment is performed to the aqueous dispersion at the temperature within a range of Tg of the toner±10° C.

<4> The method for producing a toner according to any of <1> to <3>, wherein the heat treatment is performed to the aqueous dispersion for 1 minute to 180 minutes with stirring.

<5> The method for producing a toner according to any of <1> to <4>, wherein the heat treatment is a treatment to give the aqueous dispersion the higher concentration of an ionic material contained therein after the heat treatment than the concentration of the ionic material contained in the aqueous dispersion before the heat treatment by 40 ppm or less.

<6> The method for producing a toner according to any of <1> to <5>, wherein the toner particles are obtained by emulsifying or dispersing an organic solvent solution of a toner material in a second aqueous medium, so as to produce an emulsification or dispersion liquid, and removing the organic solvent from the emulsification or dispersion liquid, wherein the toner material at least contains the binder resin or a binder resin precursor, and a colorant, and dissolved or dispersed in the organic solvent, so as to form the organic solvent solution of the toner material.

<7> The method for producing a toner according to <6>, wherein the second aqueous medium contains fine anionic resin particles having an average particle diameter of 5 nm to 50 nm and an anionic surfactant.

<8> A toner obtained by the method for producing a toner according to any of <1> to <7>.

<9> The toner according to <8>, wherein the toner has a BET specific surface area of 0.5 $m^2/g$ to 4.0 $m^2/g$.

<10> A full-color image forming method including: charging an electrophotographic photoconductor using a charging unit; exposing the charged electrophotographic photoconductor to light using an exposing unit, so as to form a latent electrostatic image thereon; developing the latent electrostatic image with a toner using a developing unit containing the toner so as to form a toner image on the electrophotographic photoconductor; primarily transferring the toner image formed on the electrophotographic photoconductor to an intermediate transfer medium using a primary transfer unit; secondarily transferring the toner image on the intermediate transfer medium to a recording medium using a secondary transfer unit; fixing the transferred toner image on the recording medium using a fixing unit containing a heat and pressure-applying member; and cleaning the toner remaining and adhering onto a surface of the electrophotographic photoconductor, from which the toner image has been transferred to the intermediate transfer medium, using a cleaning unit, wherein the toner is the toner according to any of <8> and <9>.

<11> The full-color image forming method according to <10>, wherein the linear velocity of transferring the toner image to the recording medium in the secondarily transferring is 100 mm/sec to 1,000 mm/sec, and the transfer time at a nip portion in the secondary transfer unit is 0.5 msec to 60 msec.

<12> The full-color image forming method according to any of <10> to <11>, wherein a tandem electrophotographic image forming process is used.

<13> A process cartridge adapted for use in an image forming apparatus, the process cartridge including: an electrophotographic photoconductor; and a developing unit containing the toner according to any of <8> and <9>, wherein the electrophotographic photoconductor and the developing unit are integrally supported, and the process cartridge is detachably attached to a main body of the image forming apparatus, wherein the image forming apparatus contains: the electrophotographic photoconductor; a charging unit configured to charge the electrophotographic photoconductor; an exposing unit configured to expose the charged electrophotographic photoconductor to light so as to form a latent electrostatic image thereon; the developing unit configured to develop the latent electrostatic image formed on the electrophotographic photoconductor with the toner, so as to form a toner image; a transfer unit configured to transfer the toner image formed on the electrophotographic photoconductor, via an intermediate transfer medium or directly, to a recording medium; a fixing unit configured to fix the toner image on the recording medium by means of a heat and pressure-applying member; and a cleaning unit configured to clean the toner remaining and adhering onto a surface of the electrophotographic photoconductor, from which the toner image has been transferred to the intermediate transfer medium or the recording medium using the transfer unit.

<14> The process cartridge according to <13>, further including at least one unit selected from the charging unit, the transfer unit, and the cleaning unit.

The present invention can provide a method for producing a toner, in which transfer efficiency is improved, causing no image defect during transfer, and forming images having excellent reproducibility for a long period of time in a high-speed full color image forming method, and provide a full color image forming method using the toner, and a process cartridge.

DETAILED DESCRIPTION OF THE INVENTION

Figure 1:
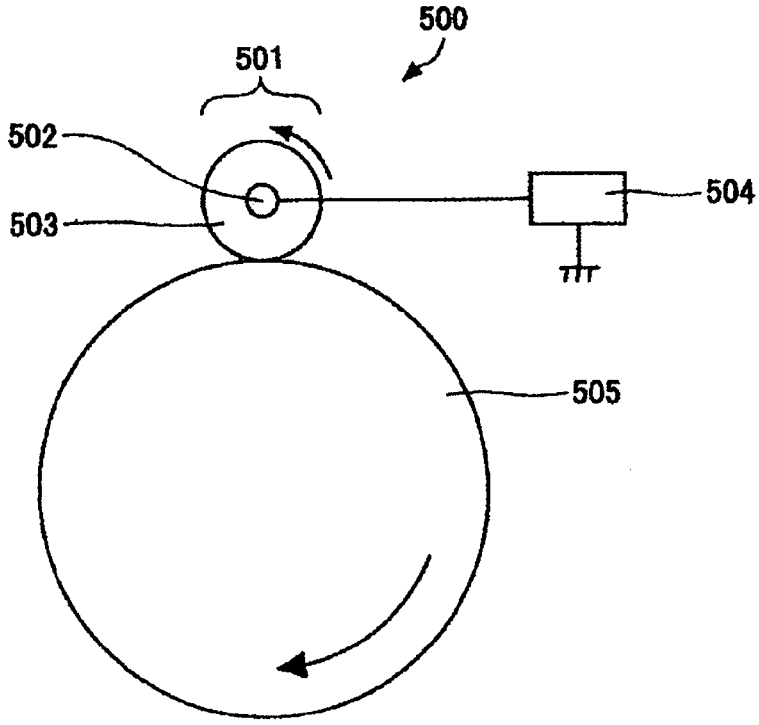
FIG. 1 is a schematic view of one exemplary contact-type roller charging device.

The best mode for carrying out the present invention will be described optionally with reference to the accompanying drawings. The aspects of the present invention can be easily properly altered or modified by the so-called person ordinary skill in the art to constitute other embodiments, and these alterations and modifications are included in the present invention. The following descriptions are examples of preferred embodiments of the invention and do not limit the present invention.

(Method for Producing Toner and Toner)

A method for producing a tone of the present invention is a method for producing a toner, including dispersing toner particles containing at least a binder resin in a first aqueous medium so as to produce an aqueous dispersion; and subjecting the aqueous dispersion to heat treatment, wherein the electric conductivity of the aqueous dispersion after the heat treatment is higher than the electric conductivity of the aqueous dispersion before the heat treatment by 50 μS/cm or less.

The toner of the present invention will be obtained by a method for producing a toner of the present invention.

In the present invention, the aqueous dispersion of toner particles is subjected to heat treatment so as to adjust the electric conductivity of the aqueous dispersion after the heat treatment higher than the electric conductivity of the aqueous dispersion before the heat treatment by 50 μS/cm or less. As a result of this unreacted components (particularly, amines) in the toner are oozed out, and then the oozed-out components adhere to the toner surface in the following filtration step, thereby preventing decrease in charge amount of the toner.

The toner of the present invention is preferably so-called a chemical toner (for example, spray-drying toner using the organic solvent phase, polymer toner, half-polymer toner) which is obtained by utilizing formation of a droplet of a solution, dispersion liquid, or melt liquid of an organic solvent phase containing a toner material to the production of the toner particles.

The toner of the present invention is more preferably obtained in the following manner: a toner material containing at least a binder resin or a binder resin precursor and a colorant is dissolved or dispersed in an organic solvent so as to form a solution or a dispersion liquid (organic solvent solution) of the toner material. Subsequently, the solution or dispersion liquid of the toner material is added to an aqueous medium $I_0$, i.e. second aqueous medium, which contains fine anionic resin particles having an average particle diameter of 5 nm to 50 nm and preferably contains an anionic surfactant, and then emulsified and/or dispersed, so as to form an emulsified and/or dispersion liquid. From the emulsified and/or dispersion liquid, the organic solvent is removed to form toner particles, and the toner particles are dispersed in an aqueous medium I, i.e. first aqueous medium, such as ion-exchanged water, so as to form an aqueous dispersion. Thereafter, the aqueous dispersion is subjected to heat treatment with stirring, to thereby obtain a toner. The weight average particle diameter of the resultant toner is preferably 1 μm to 6 μM.

Hereinafter, description will be made for the more preferred embodiment in which an aqueous medium containing fine anionic resin particles having an average particle diameter of 5 nm to 50 nm and an anionic surfactant is used as the aqueous medium $I_0$. The toner obtained by the aforementioned method contains fine resin particles adhere to a surface of the toner particle that is a core formed of a toner material mainly containing a colorant and a binder resin. The average particle diameter of the toner is adjusted under the emulsification and/or dispersion conditions of stirring an O/W suspension formed of the organic solvent containing the toner material and the aqueous medium $I_0$ in an emulsification step.

The fine anionic resin particles are attached onto the surface of the toner, and fused to and integrated with the surface of the toner particle to form a relatively hard surface. Since the fine anionic resin particles have anionic properties, the fine anionic resin particles can adsorb on the liquid droplet of the organic solvent containing the toner material to suppress coalescence between the liquid droplets. This is important for regulating the particle size distribution of the toner. Further, the fine anionic resin particles can impart negative charging ability to the toner. In order to attain these effects, the fine anionic resin particles preferably have an average particle diameter of 5 nm to 50 nm.

In order to achieve the object of the present invention, the particle diameter of each toner particle is preferably controlled so that the toner particle has a volume average particle diameter of 1 μm to 6 μm, more preferably 2 μm to 5 μm. When the volume average particle diameter of the toner particles is less than 1 μm, toner dust is likely to be generated in the primary transfer and the secondary transfer. On the other hand, when the volume average particle diameter of the toner is more than 6 μm, the dot reproducibility is unsatisfactory and the granularity of a halftone part is also deteriorated, possibly failing to obtain a high-definition image.

The charge amount of the toner obtained by the method for producing a toner of the present invention is preferably 10 μC/g to 80 μC/g as the absolute value of charge amount Q obtained when 7% by mass of the toner particles and carrier particles are mixed together for 15 sec and 600 sec. When the absolute value of the charge amount Q is less than 10 μC/g, the attractive force becomes low between the toner particles and carrier particles. In this case, a larger amount of the toner is used for development even in a low developing field. As a result, high-quality images with gradation may not be obtained. In addition, the amount of the toner having the opposite polarity increases, which may degrade image quality due to fogging and the like since a larger amount of the toner is used for development of the white background. When the absolute value of the charge amount Q is higher than 80 μC/g, the attractive force becomes high between the toner particles and magnetic carrier particles. In this case, a smaller amount of the toner is used for development, which may lead to degradation in image quality.

The common logarithmic value Log ρ of the volume specific resistance ρ (Ωcm) of the toner obtained by the method for producing a toner of the present invention is preferably 10.9 Log Ωcm to 11.4 Log Ωcm. As a result, dispersion state of a colorant and the like in the toner is excellent, thereby obtaining excellent toner charge stability, and causing less toner scattering and fogging. When the common logarithmic value Log ρ of the volume specific resistance ρ (Ωcm) of the toner is smaller than 10.9 Log Ωcm, the conductivity becomes higher to cause charging failures. As a result, background smear, toner scattering, etc. tend to increasingly occur. Moreover, an abnormal image may be formed due to electrostatic offset, and a high quality image may not be stably formed. When it is greater than 11.4 Log Ωcm, the resistance becomes higher to increase the charge amount, possibly decreasing the image density.

The average circularity of the toner particles is preferably 0.950 to 0.990. When the average circularity of the toner particles is less than 0.950, the image uniformity upon development is deteriorated, or the efficiency of transfer of the toner from the electrophotographic photoconductor to the intermediate transfer medium or from the intermediate transfer medium to the recording medium may be lowered. Consequently, uniform transfer may not be realized. The toner particles are preferably produced by emulsification treatment of the organic solvent solution containing the toner material, which contains a binder resin or a binder resin precursor, a colorant, a lubricant, and other desired materials, in the aqueous medium $I_0$, in advance of an aqueous dispersion production step using the aqueous medium I. The toner particle is effective in reducing the particle diameter of the color toner and in realizing a toner shape having an average circularity in the above-defined range.

The ratio of the weight average particle diameter (Dw) to the number average particle diameter (Dn), i.e., Dw/Dn, in the toner particle is not particularly limited and may be appropriately selected depending on the intended purpose. The ratio Dw/Dn is preferably 1.25 or less, more preferably 1.05 to 1.25. When the ratio Dw/Dn is less than 1.05, the following problems occur. Specifically, in the case of a two-component developer, toner fusion to a carrier surface occurs during long term stirring in a developing device, which may cause decrease in the charging ability of the carrier, and poor cleanability. In the case of a one-component developer, toner filming to a developing roller or toner fusing to members, such as a blade to form a thin toner film, may easily occurs. On the other hand, when the ratio Dw/Dn exceeds 1.25, it becomes difficult to provide a high-resolution, high-quality image, and variations in toner particle diameter may increase after toner consumption or toner supply in the developer. Also, the distribution of the charge amount of the toner is broadened, making it difficult to obtain a high-quality image. When the ratio Dw/Dn is 1.05 to 1.25, the distribution of the charge amount becomes uniform, which reduces fogging on the background.

When the ratio Dw/Dn is 1.05 to 1.25, the resultant toner is excellent in all of storage stability, low-temperature fixing property, and hot offset resistance. In particular, when the toner is used in a full color copier, the gloss of images is excellent. When this ratio falls within this range in the case of the two-component developer, variations in toner particle diameter are small in the developer even after toner consumption and toner supply have been repeated for a long time, and in addition, even after a long time stirring in the developing device, excellent developing ability can be ensured. Moreover, when this requirement is met in the case of the one-component developer, variations in toner particle diameter decrease even after toner consumption or toner supply, and toner filming to a developing roller and toner fusing to members, such as a blade to form a thin toner film, are prevented, and in addition, even after long-time use of the developing device, i.e. long-time stirring of developer, excellent developing ability can be ensured. Thus, a high-quality image can be obtained.

The BET specific surface area of the toner obtained by the method for producing a toner of the present invention is preferably 0.5 $m^2/g$ to 4.0 $m^2/g$, more preferably 0.5 $m^2/g$ to 2.0 $m^2/g$. When the BET specific surface area is smaller than 0.5 $m^2/g$, the toner particles are covered densely with the fine resin particles, which impair the adhesion between a recording paper and the binder resin inside the toner particles. As a result, the minimum fixing temperature may be elevated. In addition, the fine resin particles prevent wax from oozing out, resulting in that the releasing effect of the wax cannot be obtained to cause offset. When the BET specific surface area of the toner exceeds 4.0 $m^2/g$, fine organic particles remaining on the toner particle surface considerably project as protrusions. The fine resin particles remain as coarse multilayers and impair the adhesion between a recording paper and the binder resin inside the toner particles. As a result, the minimum fixing temperature may be elevated. In addition, the fine resin particles prevent wax from oozing out, failing to obtain the releasing effect of the wax, and causing offset. Furthermore, the additives protrude to form irregularities in the toner surface, which easily affects the image quality.

The weight average particle diameter of the carrier, which is used together with the toner produced by the method for producing a toner of the present invention, is not particularly limited but is preferably 15 μm to 40 μm. When the weight average particle diameter is smaller than 15 μm, carrier adhesion, which is a phenomenon that the carrier is also disadvantageously transferred in the transfer step, is likely to occur. When the weight average particle diameter is larger than 40 μm, the carrier adherence is less likely to occur. In this case, however, when the toner density is increased to provide a high image density, there is a possibility that background smear is likely to occur. Further, when the dot diameter of the latent electrostatic image is small, variation in dot reproducibility is so large that the granularity in highlight parts is likely to be deteriorated.

A method for producing the toner is exemplified in the following manner. Firstly, a toner material containing a binder resin or a binder resin precursor and a colorant is dissolved or dispersed in an organic solvent so as to form an organic solvent solution of the toner material. Subsequently, the organic solvent solution of the toner material is added to an aqueous medium $I_0$, i.e. second aqueous medium, which contains fine anionic resin particles having an average particle diameter of 5 nm to 50 nm and preferably contains an anionic surfactant, and then emulsified and/or dispersed, so as to form an emulsified and/or dispersion liquid. From the emulsified and/or dispersion liquid, the organic solvent is removed to form toner particles, and the toner particles are dispersed in an aqueous medium I, i.e. first aqueous medium, so as to form an aqueous dispersion, and the electric conductivity of the aqueous dispersion decreases to 30 μS/cm or less (aqueous dispersion production step). Subsequently, a heat treatment step in which the aqueous dispersion is subjected to heat treatment is performed. In the heat treatment step, the electric conductivity of the aqueous dispersion after the heat treatment step is adjusted to higher than the electric conductivity of the aqueous dispersion before the heat treatment step by 50 μS/cm or less.

Hereinafter, an example of the method for producing a toner will be described.

<Production of Toner Particles>

—Preparation of Organic Solvent Solution of Toner Material (Solution and/or Dispersion Liquid of Toner Material—

The organic solvent solution of the toner material is prepared by dissolving or dispersing a toner material in an organic solvent. The toner material is not particularly limited as long as it can form a toner, and may be appropriately selected depending on the intended purpose. For example, the toner material contains a binder resin and a colorant, or an active hydrogen group-containing compound, a polymer (prepolymer) reactive with the active hydrogen group-containing compound and a colorant, and further contains a releasing agent, a charge controlling agent, and other components. The organic solvent solution of the toner material is preferably prepared by dissolving or dispersing the toner material in an organic solvent. The organic solvent is preferably removed during or after formation of the toner particles.

—Organic Solvent—

The organic solvent is not particularly limited, as long as it allows the toner material to be dissolved or dispersed therein, and may be appropriately selected depending on the intended purpose. It is preferable that the organic solvent be a solvent having a boiling point of lower than 150° C. in terms of easy removal during or after formation of the toner particles. Specific examples thereof include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone and methyl isobutyl ketone. Among these solvents, ester solvents are preferable, with ethyl acetate being more preferable.

These solvents may be used alone or in combination.

The amount of the organic solvent is not particularly limited and may be appropriately selected depending on the intended purpose. Preferably, the amount of the organic solvent is 40 parts by mass to 300 parts by mass, more preferably 60 parts by mass to 140 parts by mass, particularly preferably 80 parts by mass to 120 parts by mass, based on 100 parts by mass of the toner material.

The organic solvent solution of the toner material can be prepared by dissolving or dispersing in the organic solvent the toner materials such as the active hydrogen group-containing compound, the polymer reactive with the active hydrogen group-containing compound, the unmodified polyester resin, the releasing agent, the colorant and the charge controlling agent. Of the toner material, components other than the polymer (prepolymer) reactive with the active hydrogen group-containing compound may be added and mixed in the aqueous medium $I_0$ in the preparation of the aqueous medium $I_0$ described below, or may be added together with the solution and/or dispersion liquid in the aqueous medium $I_0$ when the solution and/or dispersion liquid of the toner material is added to the aqueous medium $I_0$.

—Preparation of Emulsified and/or Dispersion Liquid—

The emulsified and/or dispersion liquid is prepared by emulsifying and/or dispersing the organic solvent solution of the toner material in the aqueous medium $I_0$, i.e. the second aqueous medium.

—Aqueous Medium $I_0$ (Second Aqueous Medium)—

The aqueous medium $I_0$, i.e. second aqueous medium is not particularly limited and may be appropriately selected from those known in the art. Examples thereof include water, water-miscible solvents and mixtures thereof. Among these, water is preferred. The water-miscible solvent is not particularly limited, as long as it is miscible with water. Examples thereof include alcohols, dimethylformamide, tetrahydrofuran, cellsolves and lower ketones. Examples of the alcohol include methanol, isopropanol and ethylene glycol. Examples of the lower ketone include acetone and methyl ethyl ketone. These may be used alone or in combination.

In this case, the aqueous medium $I_0$ is preferably prepared by, for example, dispersing fine resin particles in an aqueous medium in the presence of an anionic surfactant. The amounts of the anionic surfactant and the fine resin particles in the aqueous medium $I_0$ is not particularly limited and may be appropriately selected depending on the intended purpose. The amount of each of the anionic surfactant and the fine resin particles is preferably 0.5% by mass to 10% by mass.

The fine resin particles are not particularly limited and may be appropriately selected depending on the intended purpose. The fine anionic resin particles having an average particle diameter of 5 nm to 50 nm are preferably used.

—Emulsification and/or Dispersion—

The emulsification and/or dispersion of the organic solvent solution of the toner material in the aqueous medium $I_0$ is preferably performed by dispersing the organic solvent solution of the toner material in the aqueous medium $I_0$ with stirring. The method for dispersing the organic solvent solution of the toner material is not particularly limited and may be appropriately selected depending on the intended purpose. For example, known dispersers may be used for dispersion. The dispersers are not particularly limited, and examples thereof include low-speed shear dispersers and high-speed shear dispersers. In the method for producing a toner, during the emulsification and/or dispersion, the active hydrogen group-containing compound and the polymer (prepolymer) reactive with the active hydrogen group-containing compound are subjected to elongation reaction or crosslinking reaction, to thereby form an adhesive base material.

—Adhesive Base Material—

The adhesive base material preferably exhibits adhesiveness to a recording medium such as paper, and contains an adhesive polymer obtained through reaction of the active hydrogen group-containing compound with the polymer reactive with the active hydrogen group-containing compound in an aqueous medium $I_0$. The weight average molecular weight of the adhesive base material is not particularly limited and may be appropriately selected depending on the intended purpose. It is preferably 3,000 or higher, more preferably 5,000 to 1,000,000, particularly preferably 7,000 to 500,000. Since the weight average molecular weight is lower than 3,000, the formed toner may have degraded hot offset resistance.

The glass transition temperature, Tg, of the binder resin used as a starting material is not particularly limited and may be appropriately selected depending on the intended purpose. The glass transition temperature of the binder resin is preferably 30° C. to 70° C., more preferably 40° C. to 65° C. When the glass transition temperature, Tg, is lower than 30° C., the formed toner may have degraded heat-resistant storage stability. When the glass transition temperature, Tg, is higher than 70° C., the formed toner may have insufficient low-temperature fixing property. In an exemplary electrophotographic toner of the present embodiment, there exists a polyester resin subjected to crosslinking reaction and elongation reaction. Accordingly, even when the glass transition temperature is lower than that of the conventional polyester toner, better storage stability can be realized as compared with the conventional polyester toner.

The glass transition temperature, Tg, as used herein is determined in the following manner, using TA-60WS and DSC-60 (these are manufactured by Shimadzu Corporation) as a measuring device under the conditions given below.

Measurement Conditions

Sample container: aluminum sample pan (with a lid)
Sample amount: 5 mg
Reference: aluminum sample pan (10 mg of alumina)
Atmosphere: nitrogen (flow rate: 50 mL/min)
Temperature conditions:
Start temperature: 20° C.
Heating rate: 10° C./min
Finish temperature: 150° C.
Hold time: 0
Cooling rate: 10° C./min
Finish temperature: 20° C.
Hold time: 0
Heating rate: 10° C./min
Finish temperature: 150° C.

The measured results are analyzed using the above-mentioned data analysis software (TA-60, version 1.52) produced by Shimadzu Corporation. The analysis is performed by appointing a range of ±5° C. around a point showing the maximum peak in the lowest temperature side of DrDSC curve, which was the differential curve of the DSC curve in the second heating, and determining the peak temperature using a peak analysis function of the analysis software. Then, the maximum endotherm temperature of the DSC curve was determined in the range of the above peak temperature +5° C. and −5° C. in the DSC curve using a peak analysis function of the analysis software. The temperature shown here corresponds to Tg of the toner.

The binder resin contained in the toner is not particularly limited and may be appropriately selected depending on the intended purpose. Particularly preferred is a polyester resin. The polyester resin is not particularly limited and may be appropriately selected depending on the intended purpose. Urea-modified polyester resins, and unmodified polyester resins are particularly preferable. The urea-modified polyester resin is obtained by reacting, in the aqueous medium $I_0$, amines (B) serving as the active hydrogen group-containing compound and an isocyanate group-containing polyester prepolymer (A) serving as the polymer reactive with the active hydrogen group-containing compound. The urea-modified polyester resin may contain a urethane bonding, as well as a urea bonding. In this case, a molar ratio (urea bonding/urethane bonding) of the urea bonding to the urethane bonding is not particularly limited and may be appropriately selected depending on the intended purpose. It is preferably 100/0 to 10/90, more preferably 80/20 to 20/80, particularly preferably 60/40 to 30/70. In the case where the molar ratio of the urea bonding is less than 10, the formed toner may have degraded hot offset resistance.

Preferred examples of the urea-modified polyester resin and the unmodified polyester resin include the following.

(1) a mixture of: a urea-modified polyester resin which is obtained by modifying with isophorone diamine polyester prepolymer which is obtained by reacting isophorone diisocyanate with a polycondensation product of bisphenol A ethylene oxide (2 mol) adduct and isophthalic acid; and a polycondensation product of bisphenol A ethylene oxide (2 mol) adduct and isophthalic acid (unmodified polyester resin).

(2) a mixture of: a urea-modified polyester resin which is obtained by modifying with isophorone diamine polyester prepolymer which is obtained by reacting isophorone diisocyanate with a polycondensation product of bisphenol A ethylene oxide (2 mol) adduct and isophthalic acid; and a polycondensation product of bisphenol A ethylene oxide (2 mol) adduct and terephthalic acid (unmodified polyester resin).

(3) a mixture of: a urea-modified polyester resin which is obtained by modifying with isophorone diamine polyester prepolymer which is obtained by reacting isophorone diisocyanate with a polycondensation product of bisphenol A ethylene oxide (2 mol) adduct, bisphenol A propylene oxide (2 mol) adduct and terephthalic acid; and a polycondensation product of bisphenol A ethylene oxide (2 mol) adduct, bisphenol A propylene oxide (2 mol) adduct and terephthalic acid (unmodified polyester resin).

(4) a mixture of: a urea-modified polyester resin which is obtained by modifying with isophorone diamine polyester prepolymer which is obtained by reacting isophorone diisocyanate with a polycondensation product of bisphenol A ethylene oxide (2 mol) adduct, bisphenol A propylene oxide (2 mol) adduct and terephthalic acid; and a polycondensation product of bisphenol A propylene oxide (2 mol) adduct and terephthalic acid (unmodified polyester resin).

(5) a mixture of: a urea-modified polyester resin which is obtained by modifying with hexamethylene diamine polyester prepolymer which is obtained by reacting isophorone diisocyanate with a polycondensation product of bisphenol A ethylene oxide (2 mol) adduct and terephthalic acid; and a polycondensation product of bisphenol A ethylene oxide (2 mol) adduct and terephthalic acid (unmodified polyester resin).

(6) a mixture of: a urea-modified polyester resin which is obtained by modifying with hexamethylene diamine polyester prepolymer which is obtained by reacting isophorone diisocyanate with a polycondensation product of bisphenol A ethylene oxide (2 mol) adduct and terephthalic acid; and a polycondensation product of bisphenol A ethylene oxide (2 mol) adduct, bisphenol A propylene oxide (2 mol) adduct and terephthalic acid (unmodified polyester resin).

(7) a mixture of: a urea-modified polyester resin which is obtained by modifying with ethylene diamine polyester prepolymer which is obtained by reacting isophorone diisocyanate with a polycondensation product of bisphenol A ethylene oxide (2 mol) adduct and terephthalic acid; and a polycondensation product of bisphenol A ethylene oxide (2 mol) adduct and terephthalic acid (unmodified polyester resin).

(8) a mixture of: a urea-modified polyester resin which is obtained by modifying with hexamethylene diamine polyester prepolymer which is obtained by reacting diphenylmethane diisocyanate with a polycondensation product of bisphenol A ethylene oxide (2 mol) adduct and isophthalic acid; and a polycondensation product of bisphenol A ethylene oxide (2 mol) adduct and isophthalic acid (unmodified polyester resin).

(9) a mixture of: a urea-modified polyester resin which is obtained by modifying with hexamethylene diamine polyester prepolymer which is obtained by reacting diphenylmethane diisocyanate with a polycondensation product of bisphenol A ethylene oxide (2 mol) adduct, bisphenol A propylene oxide (2 mol) adduct, terephthalic acid and dodecenylsuccinic anhydride; and a polycondensation product of bisphenol A ethylene oxide (2 mol) adduct, bisphenol A propylene oxide (2 mol) adduct and terephthalic acid (unmodified polyester resin).

(10) a mixture of: a urea-modified polyester resin which is obtained by modifying with hexamethylene diamine polyester prepolymer which is obtained by reacting toluene diisocyanate with a polycondensation product of bisphenol A ethylene oxide (2 mol) adduct and isophthalic acid; and a polycondensation product of bisphenol A ethylene oxide (2 mol) adduct and isophthalic acid (unmodified polyester resin).

The urea-modified polyester resin is formed by, for example, the following methods.

(1) The organic solvent solution of the toner material containing the polymer reactive with the active hydrogen group-containing compound (e.g., the isocyanate group-containing polyester prepolymer (A)) is emulsified and/or dispersed in the aqueous medium $I_0$ together with the active hydrogen group-containing compound (e.g., the amine (B)) so as to form oil droplets, and these two compounds are allowed to proceed the elongation reaction and/or crosslinking reaction in the aqueous medium $I_0$.

(2) The organic solvent solution of the toner material is emulsified and/or dispersed in the aqueous medium $I_0$, to which the active hydrogen group-containing compound has previously been added, so as to form oil droplets, and these two compounds are allowed to proceed the elongation reaction and/or crosslinking reaction in the aqueous medium $I_0$.

(3) The organic solvent solution of the toner material containing the polymer reactive with the active hydrogen group-containing compound (e.g., the isocyanate group-containing polyester prepolymer (A)) is added and mixed in the aqueous medium $I_0$, the active hydrogen group-containing compound is added thereto so as to form oil droplets, and these two compounds are allowed to proceed the elongation reaction and/or crosslinking reaction from the surfaces of the particles in the aqueous medium $I_0$. In the case of (3), the modified polyester resin is preferentially formed at the surface of the toner to be formed, and thus the concentration gradation of the modified polyester resin can be provided within the toner particles.

The reaction conditions for forming the adhesive base material through emulsification and/or dispersion are not particularly limited and may be appropriately selected depending on the combination of the active hydrogen group-containing compound and the polymer reactive with the active hydrogen group-containing compound. The reaction time is preferably 10 minutes to 40 hours, more preferably 2 hours to 24 hours.

The method for stably forming the dispersion containing the polymer reactive with the active hydrogen group-containing compound (e.g., the isocyanate group-containing polyester prepolymer (A)) in the aqueous medium $I_0$ is such that the organic solvent solution of the toner material, which is prepared by dissolving and/or dispersing the toner material containing the polymer reactive with the active hydrogen group-containing compound (e.g. the isocyanate group-containing polyester prepolymer (A)), the colorant, the releasing agent, the charge controlling agent, the unmodified polyester resin, and the like, is added to the aqueous medium $I_0$, and then dispersed by shearing force.

In emulsification and/or dispersion, the amount of the aqueous medium $I_0$ used is preferably 50 parts by mass to 2,000 parts by mass, particularly preferably 100 parts by mass to 1,000 parts by mass, based on 100 parts by mass of the toner material. When the amount of the aqueous medium used is less than 50 parts by mass, the toner material is poorly dispersed, possibly failing to obtain toner particles having a predetermined particle diameter. When the amount of the aqueous medium used is more than 2,000 parts by mass, the production cost increases.

For the aqueous medium $I_0$, the following inorganic dispersants and polymer protective colloid may be used in combination with the anionic surfactant and the fine resin particles. Examples of the inorganic compound having poor water solubility include tricalcium phosphate, calcium carbonate, titanium oxide, colloidal silica, and hydroxyapatite.

—Polymer Protective Colloid—

The polymer protective colloid is not particularly limited and may be appropriately selected depending on the intended purpose. Examples thereof include acids, (meth)acrylic monomers having a hydroxyl group, vinyl alcohols or ethers of vinyl alcohols, esters of vinyl alcohol and compounds having a carboxyl group, amide compounds or methylol compounds thereof, chlorides, homopolymers or copolymers of a compound containing a nitrogen atom or a nitrogen-containing heterocyclic ring, polyoxyethylene, and celluloses.

Examples of the acids include acrylic acid, methacrylic acid, α-cyanoacrylic acid, α-cyanomethacrylic acid, itaconic acid, crotonic acid, fumaric acid, maleic acid, and maleic anhydride.

Examples of the (meth)acrylic monomers having a hydroxyl group include β-hydroxyethyl acrylate, β-hydroxyethyl methacrylate, β-hydroxylpropyl acrylate, β-hydroxylpropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin monoacrylate, glycerin monomethacrylate, N-methylolacrylamide, and N-methylolmethacrylamide.

Examples of the vinyl alcohols or ethers of vinyl alcohols include vinyl methyl ether, vinyl ethyl ether, and vinyl propyl ether.

Examples of the esters of vinyl alcohols and compounds having a carboxyl group include vinyl acetate, vinyl propionate, and vinyl butyrate.

Examples of the amide compounds or methylol compounds thereof include acryl amide, methacryl amide, diacetone acryl amide acid, and methylol compounds thereof.

Examples of the chlorides include acrylic acid chloride, and methacrylic acid chloride.

Examples of the homopolymers or copolymers of a compound containing a nitrogen atom or a nitrogen-containing heterocyclic ring include vinyl pyridine, vinyl pyrrolidone, vinyl imidazole, and ethylene imine.

Examples of the polyoxy ethylene include polyoxyethylene, polyoxypropylene, polyoxyethylene alkylamine, polyoxypropylene alkylamine, polyoxyethylene alkylamide, polyoxypropylene alkylamide, polyoxyethylene nonylphenylether, polyoxyethylene laurylphenylether, polyoxyethylene stearylphenylester, and polyoxyethylene nonylphenylester.

Examples of the cellulose include methyl cellulose, hydroxyethyl cellulose, and hydroxypropyl cellulose.

When a dispersion stabilizer (e.g., calcium phosphate) soluble in an acid or alkalis used with the aqueous medium $I_0$, the calcium phosphate can be removed from the particles by dissolving it with an acid such as hydrochloric acid, followed by washing with water; or by enzymatically decomposing it.

—Removal of Organic Solvent—

The organic solvent is removed from emulsified slurry (emulsion and/or dispersion liquid) obtained by emulsification and/or dispersion. The method for removing the organic solvent is performed as follows: (1) the entire reaction system is gradually increased in temperature to completely evaporate the organic solvent contained in oil droplets; or (2) the emulsified dispersion is sprayed in a dry atmosphere to completely remove and evaporate the water insoluble organic solvent contained in oil droplets together with the aqueous dispersant, whereby fine toner particles are formed. By removing the organic solvent, toner particles are formed.

<Aqueous Dispersion Production Step>

The aqueous dispersion production step is not particularly limited as long as the organic solvent is removed to form toner particles, and the resultant toner particles are dispersed in the aqueous medium I, i.e. first aqueous medium so as to form an aqueous dispersion, and may be appropriately selected depending on the intended purpose. The aqueous dispersion production step preferably includes washing the toner particles with the aqueous medium I, i.e. first aqueous medium to form an aqueous dispersion having an electric conductivity of 30 μS/cm or less. Namely, the step preferably includes the process of decreasing the electric conductivity of the aqueous dispersion to 30 μS/cm or less. The aqueous medium I, i.e. first aqueous medium differs from the aqueous medium $I_0$, i.e. second aqueous medium, and is used for subjecting the formed toner particles to washing and modification including shape control. On the other hand, the aqueous medium $I_0$ is used for emulsifying and/or dispersing the organic solvent solution of the toner material, so as to form droplets, for the purpose of producing toner base particles. As the aqueous medium I, pure water, ion-exchanged water, or distilled water is used, and it is preferred that the aqueous medium I do not contain an ionic material, particularly a cationic material.

<Heat Treatment Step>

The heat treatment step is not particularly limited, and may be appropriately selected depending on the intended purpose, as long as the aqueous dispersion is subjected to heat treatment so as to adjust the electric conductivity of the aqueous dispersion after the heat treatment step higher than the electric conductivity of the aqueous dispersion before the heat treatment step by 50 μS/cm or less. Namely the electric conductivity of the aqueous dispersion after the heat treatment step increases by 50 μS/cm or less, compared with the electric conductivity of the aqueous dispersion before the heat treatment step. In the heat treatment step, the increasing amount of the electric conductivity of the aqueous dispersion is 50 μS/cm or less as described above. The minimum of the increasing amount may be 0 μS/cm. For example, the heat treatment may be performed with stirring, so as to form toner particles each having smooth surface. In the case where the toner particles are dispersed in ion-exchanged water, the heat treatment may be performed before or after washing.

In the heat treatment step, the aqueous dispersion is preferably heated at the temperature within a range of Tg of the toner±10° C.

In the heat treatment step, the aqueous dispersion is preferably heated for 1 minute to 180 minutes with stirring.

In the heat treatment step, the concentration of an ionic material contained in the aqueous dispersion after the heat treatment step is preferably higher than the concentration of the ionic material contained in the aqueous dispersion before heat treatment step by 40 ppm or less. Namely, the concentration of the ionic material contained in the aqueous dispersion after the heat treatment step increases by 40 ppm or less, compared with the concentration of the ionic material contained in the aqueous dispersion before the heat treatment step. In the heat treatment step, the increasing amount of the concentration of the ionic material is 40 ppm or less as described above. The minimum of the increasing amount may be 0 ppm.

<Drying>

The thus-formed toner particles are subjected to drying, etc., and then, if necessary, to classification, etc. Classification is performed by removing very fine particles using a cyclone, a decanter, a centrifugal separator, etc. in the liquid. Alternatively, after drying, the formed powdery toner particles may be classified.

The toner particles produced through the above-described steps may be mixed with, for example, a colorant, a releasing agent and a charge controlling agent, or a mechanical impact may be applied to the resultant mixture (toner particles) for preventing particles of the releasing agent, etc. from dropping off from the surfaces of the toner particles. Examples of the method for applying a mechanical impact include a method in which an impact is applied to a mixture using a high-speed rotating blade, and a method in which impact is applied by putting mixed particles into a high-speed air flow and accelerating the air speed such that the particles collide with one another or that the particles are crashed into a proper collision plate. Examples of apparatuses used in these methods include ANGMILL (manufactured by Hosokawa Micron Corporation), an apparatus produced by modifying I-type mill (manufactured by Nippon Pneumatic Mfg. Co., Ltd.) so that the pulverizing air pressure thereof is decreased, hybridization system (manufactured by Nara Machinery Co., Ltd.), kryptron system (manufactured by Kawasaki Heavy Industries, Ltd.), and automatic mortar.

Hereinafter, materials used for the method for producing a toner of the present invention and the toner of the present invention will be described.

<Fine Resin Particles>

A resin used as the fine resin particles is not particularly limited as long as the resin can form an aqueous dispersion liquid in the aqueous medium $I_0$, and may be appropriately selected from known resins depending on the intended purpose.

The resin used as the fine resin particles may be a thermoplastic or thermosetting resin. Examples thereof include vinyl resins, polyurethane resins, epoxy resins, polyester resins, polyamide resins, polyimide resins, silicon resins, phenol resins, melamine resins, urea resins, aniline resins, ionomer resins and polycarbonate resins. These may be used alone or in combination. Among these, at least one selected from vinyl resins, polyurethane resins, epoxy resins and polyester resins is preferable, from the viewpoint of easily preparing an aqueous dispersion liquid containing spherical fine resin particles. Notably, the vinyl resin is a homopolymer or copolymer of a vinyl monomer. Examples thereof include styrene-(meth) acrylate ester resins, styrene-butadiene copolymers, (meth) acrylic acid-acrylate ester polymers, styrene-acrylonitrile copolymers, styrene-maleic anhydride copolymers and styrene-(meth)acrylic acid copolymers.

The fine resin particles must be anionic to avoid aggregation when used in combination with the above-described anionic surfactant. The fine resin particles can be prepared by using an anionic active agent in the below-described methods or by introducing into a resin an anionic group such as a carboxylic acid group and/or a sulfonic acid group.

As the particle diameter of each fine resin particle, the average particle diameter of the primary particles is 5 nm to 50 nm. This is important for regulating the particle diameter and the particle size distribution of the emulsified particles. It is more preferably 10 nm to 25 nm. The average particle diameter of the primary particles can be measured by, for example, SEM, TEM or a light scattering method. Specifically, LA-920 (manufactured by HORIBA, Ltd.) based on a laser scattering method can be used for measurement so that the primary particles are diluted to a proper concentration at which the measured value falls within the measurement range. The particle diameter is determined as a volume average diameter.

The fine resin particles can be obtained by polymerization according to the known method appropriately selected depending on the intended purpose. The fine resin particles are preferably obtained in a form of an aqueous dispersion liquid of the fine resin particles. The method of preparing the aqueous dispersion liquid of fine resin particles is preferably as follows, for example:

(1) in the case of vinyl resins, a method in which an aqueous dispersion liquid of fine resin particles is directly produced by subjecting a vinyl monomer serving as a starting material to polymerization reaction by any one of a suspension polymerization method, an emulsification polymerization method, a seed polymerization method and a dispersion polymerization method;

(2) in the case of polyadded or condensed resins such as polyester resins, polyurethane resins and epoxy resins, a method in which an aqueous dispersion liquid of fine particles of the polyadded or condensed resins is produced by dispersing their precursor (e.g., monomer or oligomer) or a solution thereof in an aqueous medium in the presence of an appropriate dispersant and then curing the resultant dispersion with heating or through addition of a curing agent;

(3) in the case of polyadded or condensed resins such as polyester resins, polyurethane resins and epoxy resins, a method in which an aqueous dispersion of fine particles of the polyadded or condensed resins is produced by dissolving an appropriate emulsifier in their precursor (e.g., monomer or oligomer) or a solution thereof (which is preferably a liquid or may be liquefied with heating) and then adding water to the resultant mixture for phase inversion emulsification;

(4) a method in which a resin is prepared through polymerization reaction (e.g., addition polymerization, ring-opening polymerization, polyaddition, addition condensation or condensation polymerization); the thus-prepared resin is pulverized using a mechanically rotary pulverizer, a jet pulverizer, etc., and then classified; and the thus-formed fine resin particles are dispersed in water in the presence of an appropriate dispersant;

(5) a method in which a resin is prepared through polymerization reaction (e.g., addition polymerization, ring-opening polymerization, polyaddition, addition condensation or condensation polymerization); the thus-prepared resin is dissolved in a solvent to prepare a resin solution; the thus-prepared resin solution is sprayed to produce fine resin particles; and the thus-produced fine resin particles are dispersed in water in the presence of an appropriate dispersant;

(6) a method in which a resin is prepared through polymerization reaction (e.g., addition polymerization, ring-opening polymerization, polyaddition, addition condensation or condensation polymerization); the thus-prepared resin is dissolved in a solvent to prepare a resin solution, followed by addition of a poor solvent for precipitation, or the thus-prepared resin is dissolved with heating in a solvent to prepare a resin solution, followed by cooling for precipitation; the solvent is removed to produce fine resin particles; and the thus-produced fine resin particles are dispersed in water in the presence of an appropriate dispersant;

(7) a method in which a resin is prepared through polymerization reaction (e.g., addition polymerization, ring-opening polymerization, polyaddition, addition condensation or condensation polymerization); the thus-prepared resin is dissolved in a solvent to prepare a resin solution; the thus-prepared resin solution is dispersed in an aqueous medium in the presence of an appropriate dispersant; and the solvent is removed with heating or under reduced pressure; and (8) a method in which a resin is prepared through polymerization reaction (e.g., addition polymerization, ring-opening polymerization, polyaddition, addition condensation or condensation polymerization); the thus-prepared resin is dissolved in a solvent to prepare a resin solution; an appropriate emulsifier is dissolved in the thus-prepared resin solution; and water is added to the resultant solution for phase inversion emulsification.

<Anionic Surfactant>

Examples of anionic surfactants used in the method for producing a toner of the present invention include alkylbenzene sulfonic acid salts, α-olefin sulfonic acid salts, phosphates, and anionic surfactants having a fluoroalkyl group. Among these, the anionic surfactants having a fluoroalkyl group are preferable. Examples of the anionic surfactants having a fluoroalkyl group include fluoroalkyl carboxylic acids having 2 to 10 carbon atoms or metal salts thereof, disodium perfluorooctanesulfonylglutamate, sodium-3-[ω-fluoroalkyl (C6 to C11)oxy]-1-alkyl (C3 to C4) sulfonate, sodium-3-[ω-fluoroalkanoyl (C6 to C8)-N-ethylamino]-1-propanesulfonate, fluoroalkyl (C11 to C20) carboxylic acids or metal salts thereof, perfluoroalkyl (C7 to C13) carboxylic acids or metal salts thereof, perfluoroalkyl (C4 to C12) sulfonic acid or metal salts thereof, perfluorooctanesulfonic acid diethanol amide, N-propyl-N-(2-hydroxyethyl)perfluorooctanesulfone amide, perfluoroalkyl (C6 to C10) sulfoneamidepropyltrimethylammonium salts, perfluoroalkyl (C6 to C10)-N-ethylsulfonyl glycin salts, and monoperfluoroalkyl (C6 to C16)ethylphosphate ester.

Examples of commercially available products of the fluoroalkyl group-containing anionic surfactants include, but not limited to, SURFLON S-111, S-112 and S-113 (manufactured by Asahi Glass Co., Ltd.); FLUORAD FC-93, FC-95, FC-98 and FC-129 (manufactured by Sumitomo 3M Limited); UNIDYNE DS-101 and DS-102 (manufactured by Daikin Industries, Ltd.); MEGAFACE F-110, F-120, F-113, F-191, F-812 and F-833 (manufactured by Dainippon Ink and Chemicals, Incorporated); EETOP EF-102, 103, 104, 105, 112, 123A, 123B, 306A, 501, 201 and 204 (manufactured by Tohchem Products Co., Ltd.); FTERGENT F-100 and F-150 (manufactured by NEOS COMPANY LIMITED).

<Binder Resin>

The binder resin contained in the toner material used in the method for producing a toner of the present invention is not particularly limited and may be appropriately selected from known binder resins depending on the intended purpose. Specific examples thereof include polyester resins, silicone resins, styrene-acrylic resins, styrene resins, acrylic resins, epoxy resins, diene resins, phenol resins, terpene resins, coumarin resins, amide imide resins, butyral resins, urethane resins, and ethylene vinyl acetate resins.

Among these, polyester resins are particularly preferable because of being sharply melted upon fixing, being capable of smoothing the image surface, having sufficient flexibility even if the molecular weight thereof is lowered. The polyester resins may be used in combination with another resin.

The polyester resins are preferably produced through reaction between one or more polyols represented by the following General Formula (1) and one or more polycarboxylic acids represented by the following General Formula (2):

A-(OH)m General Formula (1)

in General Formula (1), A represents an alkyl group having 1 to 20 carbon atoms, an alkylene group having 1 to 20 carbon atoms, an aromatic group which may have a substituent, or a heterocyclic aromatic group which may have a substituent; and m is an integer of 2 to 4, B—(COOH)n General Formula (2)

in General Formula (2), B represents an alkyl group having 1 to 20 carbon atoms, an alkylene group having 1 to 20 carbon atoms, an aromatic group which may have a substituent, or a heterocyclic aromatic group which may have a substituent; and n is an integer of 2 to 4.

Examples of the polyols represented by General Formula (1) include ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, bisphenol A, ethylene oxide adducts of bisphenol A, propylene oxide adducts of bisphenol A, hydrogenated bisphenol A, ethylene oxide adducts of hydrogenated bisphenol A, and propylene oxide adducts of hydrogenated bisphenol A.

Examples of the polycarboxylic acids represented by General Formula (2) include maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenylsuccinic acid, isooctylsuccinic acid, isododecenylsuccinic acid, n-dodecylsuccinic acid, isododecylsuccinic acid, n-octenylsuccinic acid, n-octylsuccinic acid, isooctenylsuccinic acid, isooctylsuccinic acid, 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, Enpol trimer acid, cyclohexanedicarboxylic acid, cyclohexenedicarboxylic acid, butanetetracarboxylic acid, diphenylsulfonetetracarboxylic acid, and ethylene glycolbis(trimellitic acid).

<Active Hydrogen Group-Containing Compound>

When the toner material contains the active hydrogen group-containing compound and a polymer reactive with the compound, the mechanical strength of the resultant toner is increased and embedding of fine resin particles and external additives can be suppressed. When the active hydrogen group-containing compound has a cationic polarity, it can electrostatically pull the fine resin particles. Further, the fluidity of the toner during the heat fixation can be regulated, and, consequently, the fixing temperature range can be broadened.

Notably, the active hydrogen group-containing compound and the polymer reactive with the active hydrogen group-containing compound can be said to be a binder resin precursor.

The active hydrogen group-containing compound serves, in the aqueous medium $I_0$, as an elongating agent, a crosslinking agent, etc. for reactions of elongation, crosslinking, etc. of a polymer reactive with the active hydrogen group-containing compound.

The active hydrogen group-containing compound is not particularly limited, as long as it contains an active hydrogen group, and may be appropriately selected depending on the intended purpose. For example, when the polymer reactive with the active hydrogen group-containing compound is an isocyanate group-containing polyester prepolymer (A), an amine (B) is preferably used as the active hydrogen group-containing compound, since it can provide a high-molecular-weight product through reactions of elongation, crosslinking, etc. with the isocyanate group-containing polyester prepolymer (A).

The active hydrogen group is not particularly limited, as long as it contains an active hydrogen atom, and may be appropriately selected depending on the intended purpose. Examples thereof include a hydroxyl group (alcoholic or phenolic hydroxyl group), an amino group, a carboxylic group and a mercapto group. These may be used alone or in combination.

The amine (B) is not particularly limited and may be appropriately selected depending on the intended purpose. Examples thereof include diamines (B1), trivalent or higher polyamines (B2), amino alcohols (B3), aminomercaptans (B4), amino acids (B5), and amino-blocked products (B6) of the amines (B1) to (B5). These may be used alone or in combination. Among these, preferred are diamines (B1) and a mixture of the diamines (B1) and a small amount of the trivalent or higher polyamines (B2).

Examples of the diamines (B1) include aromatic diamines, alicyclic diamines and aliphatic diamines.

Examples of the aromatic diamines include phenylenediamine, diethyltoluenediamine and 4,4'-diaminodiphenylmethane.

Examples of the alicyclic diamines include 4,4'-diamino-3,3'-dimethyldicyclohexylmethane, diaminecyclohexane and isophoronediamine.

Examples of the aliphatic diamines include ethylenediamine, tetramethylenediamine and hexamethylenediamine.

Examples of the trivalent or higher polyamines (B2) include diethylenetriamine and triethylenetetramine.

Examples of the amino alcohols (B3) include ethanolamine and hydroxyethylaniline.

Examples of the aminomercaptans (B4) include aminoethyl mercaptan and aminopropyl mercaptan.

Examples of the amino acids (B5) include aminopropionic acid and aminocaproic acid.

Examples of the amino-blocked products (B6) include ketimine compounds and oxazolidine compounds derived from the amines (B1) to (B5) and ketones (e.g., acetone, methyl ethyl ketone and methyl isobutyl ketone).

Also, a reaction terminator is used for terminating elongation/crosslinking reaction between the active hydrogen group-containing compound and the polymer reactive therewith. Use of the reaction terminator can control the adhesive base material in its molecular weight, etc. to a desired range. The reaction terminator is not particularly limited, and examples thereof include monoamines (e.g., diethyl amine, dibutyl amine, butyl amine and lauryl amine) and blocked products thereof (e.g., ketimine compounds).

The mixing ratio of the isocyanate group-containing polyester prepolymer (A) to the amine (B) is not particularly limited but preferably 1/3 to 3/1, more preferably 1/2 to 2/1, particularly preferably 1/1.5 to 1.5/1, in terms of the equivalent ratio ([NCO]/[NHx]) of isocyanate group [NCO] in the isocyanate group-containing prepolymer (A) to amino group [NHx] in the amine (B). When the equivalent ratio ([NCO]/[NHx]) is less than 1/3, the formed toner may have degraded low-temperature fixing property. When the equivalent ratio ([NCO]/[NHx]) is more than 3/1, the molecular weight of the urea-modified polyester resin decreases, resulting in that the formed toner may have degraded hot offset resistance.

<Polymer Reactive with Active Hydrogen Group-Containing Compound>

The polymer reactive with the active hydrogen group-containing compound (hereinafter also referred to as a "prepolymer") is not particularly limited, as long as it has at least a site reactive with the active hydrogen group-containing compound, and may be appropriately selected from known resins. Examples thereof include polyol resins, polyacrylic resins, polyester resins, epoxy resins, and derivative resins thereof. Among these, polyester resins are preferred since they have high fluidity upon melting and high transparency. These may be used alone or in combination.

In the prepolymer, the reaction site reactive with the active hydrogen group-containing group is not particularly limited. Appropriately selected known substituents (moieties) may be used as the reaction site. Examples thereof include an isocyanate group, an epoxy group, a carboxyl group and an acid chloride group. These may be used alone or in combination as the reaction site. Among them, an isocyanate group is particularly preferred. As the prepolymer, a urea bond-forming group-containing polyester resin (RMPE) containing a urea bond-forming group is preferred, since it is easily adjusted for the molecular weight of the polymeric component thereof and thus is preferably used for forming dry toner, in particular for assuring oil-less low temperature fixing property (e.g., releasing and fixing properties requiring no releasing oil-application mechanism for a heat-fixing medium).

Examples of the urea bond-forming group include an isocyanate group. Preferred examples of the RMPE having an isocyanate group as the urea bond-forming group include the isocyanate group-containing polyester prepolymer (A). The isocyanate group-containing polyester prepolymer (A) is not particularly limited and may be appropriately selected depending on the intended purpose. Examples thereof include those produced as follows: a polyol (PO) is polycondensed with a polycarboxylic acid (PC) to form a resin having an active hydrogen-containing group; and the thus-formed polyester is reacted with a polyisocyanate (PIC).

The polyol (PO) is not particularly limited and may be appropriately selected depending on the intended purpose. Examples thereof include diols (DIOs), trihydric or higher polyols (TOs), and mixtures of diols (DIOs) and trihydric or higher polyols (TOs). These may be used alone or in combination. Among these, preferred are diols (DIOs) and mixtures of diols (DIOs) and a small amount of trihydric or higher polyols (TOs).

Examples of the diol (DIO) include alkylene glycols, alkylene ether glycols, alicyclic diols, alkylene oxide adducts of alicyclic diols, bisphenols, and alkylene oxide adducts of bisphenols.

The alkylene glycol is preferably those having 2 to 12 carbon atoms, and examples thereof include ethylene glycol, 1,2-propylene glycol, 1,3-propylene glycol, 1,4-butanediol and 1,6-hexanediol.

Examples of the alkylene ether glycol include diethylene glycol, triethylene glycol, dipropylene glycol, polyethylene glycol, polypropylene glycol and polytetramethylene ether glycol.

Examples of the alicyclic diol include 1,4-cyclohexane dimethanol and hydrogenated bisphenol A.

Examples of the alkylene oxide adducts of alicyclic diols include adducts of the alicyclic diols with alkylene oxides (e.g., ethylene oxide, propylene oxide and butylene oxide).

Examples of the bisphenol include bisphenol A, bisphenol F and bisphenol S.

Examples of the alkylene oxide adducts of bisphenols include adducts of the bisphenols with alkylene oxides (e.g., ethylene oxide, propylene oxide and butylene oxide).

Among these, preferred are alkylene glycols having 2 to 12 carbon atoms and alkylene oxide adducts of bisphenols, particularly preferred are alkylene oxide adducts of bisphenols, and mixtures of alkylene glycols having 2 to 12 carbon atoms and alkylene oxide adducts of bisphenols.

As the trihydric or higher polyol (TO) trihydric to octahydric polyols are preferably used. Examples thereof include trihydric or higher aliphatic alcohols, and trihydric or higher polyphenols, and alkylene oxide adducts of the trihydric or higher polyphenols.

Examples of the trihydric or higher aliphatic alcohols include glycerin, trimethylolethane, trimethylolpropane, pentaerythritol and sorbitol.

Examples of the trihydric or higher polyphenols include trisphenol compounds (e.g., trisphenol PA, manufactured by HONSHU CHEMICAL INDUSTRY CO., LTD.), phenol novolak and cresol novolak.

Examples of the alkylene oxide adducts of the trihydric or higher polyphenols include adducts of the trihydric or higher polyphenols with alkylene oxides (e.g., ethylene oxide, propylene oxide and butylene oxide).

In the mixture of the diol (DIO) and the trihydric or higher polyol (TO), the mixing ratio by mass (DIO:TO) is preferably 100:0.01 to 100:10, more preferably 100:0.01 to 100:1.

The polycarboxylic acid (PC) is not particularly limited and may be appropriately selected depending on the intended purpose. Examples thereof include dicarboxylic acids (DICs), tri- or higher polycarboxylic acids (TCs), and mixtures of dicarboxylic acids (DICs) and the tri- or higher polycarboxylic acids (TCs). These may be used alone or in combination. Among these, preferred are dicarboxylic acids (DICs) and mixtures of DICs and a small amount of tri- or higher polycarboxylic acids (TCs).

Examples of the dicarboxylic acid (DIC) include alkylene dicarboxylic acids, alkenylene dicarboxylic acids, and aromatic dicarboxylic acids.

Examples of the alkylene dicarboxylic acid include succinic acid, adipic acid and sebacic acid. The alkenylene dicarboxylic acid is preferably those having 4 to 20 carbon atoms, and examples thereof include maleic acid and fumaric acid.

The aromatic dicarboxylic acid is preferably those having 8 to 20 carbon atoms, and examples thereof include phthalic acid, isophthalic acid, terephthalic acid, and naphthalenedicarboxylic acid.

Among these, preferred are alkenylene dicarboxylic acids having 4 to 20 carbon atoms and aromatic dicarboxylic acids having 8 to 20 carbon atoms.

Examples of the tri- or higher polycarboxylic acid (TC) include aromatic polycarboxylic acids.

The aromatic polycarboxylic acid is preferably those having 9 to 20 carbon atoms, and examples thereof include trimellitic acid and pyromellitic acid.

Alternatively, as the polycarboxylic acid (PC), there may be used acid anhydrides or lower alkyl esters of the dicarboxylic acids (DICs), the tri- or higher polycarboxylic acid (TCs), or mixtures of the dicarboxylic acid (DICs) and the tri- or higher polycarboxylic acid (TCs). Examples of the lower alkyl ester thereof include methyl esters thereof, ethyl esters thereof and isopropyl esters thereof.

In the mixture of the dicarboxylic acid (DIC) and the tri- or higher polycarboxylic acid (TC), the mixing ratio by mass (DIC:TC) is not particularly limited and may be appropriately selected depending on the intended purpose. Preferably, the mixing ratio (DIC:TC) is 100:0.01 to 100:10, more preferably 100:0.01 to 100:1.

In polycondensation reaction between the polyol (PO) and the polycarboxylic acid (PC), the mixing ratio of PO to PC is not particularly limited and may be appropriately selected depending on the intended purpose. The mixing ratio PO/PC is preferably 2/1 to 1/1, more preferably 1.5/1 to 1/1, particularly preferably 1.3/1 to 1.02/1, in terms of the equivalent ratio ([OH]/[COOH]) of hydroxyl group [OH] in the polyol (PO) to carboxyl group [COOH] in the polycarboxylic acid (PC).

The content of the polyol (PO) in the isocyanate group-containing polyester prepolymer (A) is not particularly limited and may be appropriately selected depending on the intended purpose. For example, it is preferably 0.5% by mass to 40% by mass, more preferably 1% by mass to 30% by mass, particularly preferably 2% by mass to 20% by mass. When the content of the polyol (PO) is less than 0.5% by mass, the formed toner has degraded hot offset resistance, making it difficult for the toner to attain both desired heat-resistant storage stability and desired low-temperature fixing property. When the content of the polyol (PO) is more than 40% by mass, the formed toner may have degraded low-temperature fixing property.

The polyisocyanate (PIC) is not particularly limited and may be appropriately selected depending on the intended purpose. Examples thereof include aliphatic polyisocyanates, alicyclic polyisocyanates, aromatic diisocyanates, aromatic/aliphatic diisocyanates, isocyanurates, phenol derivatives thereof, and blocked products thereof with oxime, caprolactam, etc.

Examples of the aliphatic polyisocyanate include tetramethylene diisocyanate, hexamethylene diisocyanate, 2,6-diisocyanatomethylcaproate, octamethylene diisocyanate, decamethylene diisocyanate, dodecamethylene diisocyanate, tetradecamethylene diisocyanate, trimethylhexane diisocyanate, and tetramethylhexane diisocyanate.

Examples of the alicyclic polyisocyanate include isophorone diisocyanate and cyclohexylmethane diisocyanate.

Examples of the aromatic diisocyanate include tolylene diisocyanate, diphenylmethane diisocyanate, 1,5-naphthylene diisocyanate, diphenylene-4,4'-diisocyanate, 4,4'-diisocyanato-3,3'-dimethyldiphenyl, 3-methyldiphenylmethane-4,4'-diisocyanate and diphenylether-4,4'-diisocyanate.

Examples of the aromatic/aliphatic diisocyanate include α,α,α',α'-tetramethylxylylene diisocyanate.

Examples of the isocyanurate include tris-isocyanatoalkyl-isocyanurate and triisocyanatocycloalkyl-isocyanurate.

These may be used alone or in combination.

In reaction between the polyisocyanate (PIC) and the polyester resin having an active hydrogen group (e.g., hydroxyl group-containing polyester resin), the ratio of the PIC to the hydroxyl group-containing polyester resin is preferably 5/1 to 1/1, more preferably 4/1 to 1.2/1, particularly preferably 3/1 to 1.5/1, in terms of the mixing equivalent ratio ([NCO]/[OH]) of an isocyanate group [NCO] in the polyisocyanate (PIC) to a hydroxyl group [OH] in the hydroxyl group-containing polyester resin. When the mixing equivalent ratio [NCO]/[OH] is more than 5/1, the formed toner may have degraded low-temperature fixing property; whereas when the mixing equivalent ratio [NCO]/[OH] is less than 1/1, the formed toner may have degraded offset resistance.

The content of the polyisocyanate (PIC) in the isocyanate group-containing polyester prepolymer (A) is not particularly limited and can be appropriately determined depending on the intended purpose. For example, it is preferably 0.5% by mass to 40% by mass, more preferably 1% by mass to 30% by mass, still more preferably 2% by mass to 20% by mass. When the content of the polyisocyanate (PIC) is less than 0.5% by mass, the formed toner may have degraded hot offset resistance, making it difficult for the toner to attain both desired heat-resistant storage stability and desired low-temperature fixing property. When the content of the polyisocyanate (PIC) is more than 40% by mass, the formed toner may have degraded low-temperature fixing property.

The average number of isocyanate groups per molecule of the isocyanate group-containing polyester prepolymer (A) is not particularly limited but is preferably one or more, more preferably 1.2 to 5, still more preferably 1.5 to 4. When the average number of the isocyanate groups is less than one per one molecule, the molecular weight of the polyester resin modified with a urea bond-forming group (RMPE) decreases, resulting in that the formed toner may have degraded hot offset resistance.

The weight average molecular weight (Mw) of the polymer reactive with the active hydrogen group-containing compound is not particularly limited but is preferably 3,000 to 40,000, more preferably 4,000 to 30,000 based on the molecular weight distribution obtained by analyzing tetrahydrofuran (THF) soluble matter of the polymer through gel permeation chromatography (GPC). When the weight average molecular weight (Mw) is lower than 3,000, the formed toner may have degraded heat-resistant storage stability; whereas when the Mw is higher than 40,000, the formed toner may have degraded low-temperature fixing property.

The gel permeation chromatography (GPC) for measuring the molecular weight distribution can be performed, for example, as follows. Specifically, a column is conditioned in a heat chamber at 40° C., and then tetrahydrofuran (THF) (solvent) is caused to pass through the column at a flow rate of 1 mL/min while the temperature is maintained. Subsequently, a separately prepared tetrahydrofuran solution of a resin sample (concentration: 0.05% by mass to 0.6% by mass) is applied to the column in an amount of 50 μL to 200 μL. In the measurement of the molecular weight of the sample, the molecular weight distribution is determined based on the relationship between the logarithmic value and the count number of a calibration curve given by using several monodisperse polystyrene-standard samples. The standard polystyrenes used for giving the calibration curve may be, for example, those available from Pressure Chemical Co. or Tosoh Corporation; i.e., those each having a molecular weight of $6\times10^2$, $2.1\times10^2$, $4\times10^2$, $1.75\times10^4$, $1.1\times10^5$, $3.9\times10^5$, $8.6\times10^5$, $2\times10^6$ and $4.48\times10^6$. Preferably, at least about 10 standard polystyrenes are used for giving the calibration curve. The detector which can be used is a refractive index (RI) detector.

<Other Components>

Other components are not particularly limited and may be appropriately selected depending on the intended purpose. Examples thereof include colorants, releasing agents, charge controlling agents, fine inorganic particles, flowability improvers, cleaning improvers, magnetic materials and metal soaps.

—Colorant—

The colorant is not particularly limited and may be appropriately selected depending on the intended purpose from known dyes and pigments. Examples thereof include carbon black, nigrosine dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazinelake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro anilin red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red F5R, brilliant carmin 6B, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanin blue, phthalocyanin blue, fast sky blue, indanthrene blue (RS and BC), indigo, ultramarine, iron blue, anthraquinon blue, fast violet B, methylviolet lake, cobalt purple, manganese violet, dioxane violet, anthraquinon violet, chrome green, zinc green, chromium oxide, viridian, emerald green, pigment green B, naphthol green B, green gold, acid green lake, malachite green lake, phthalocyanine green, anthraquinon green, titanium oxide, zinc flower and lithopone. These colorants may be used alone or in combination.

The amount of the colorant contained in the toner is not particularly limited and may be appropriately determined depending on the intended purpose. It is preferably 1% by mass to 15% by mass, more preferably 3% by mass to 10% by mass. When the amount of the colorant is less than 1% by mass, the formed toner may degrade in coloring performance. Whereas when the amount is more than 15% by mass, the pigment is not sufficiently dispersed in the toner, possibly causing decrease in coloring performance and in electrical properties of the formed toner.

The colorant may be mixed with a resin to form a masterbatch. The resin is not particularly limited and may be appropriately selected from those known in the art. Examples thereof include polyesters, polymers of a substituted or unsubstituted styrene, styrene copolymers, polymethyl methacrylates, polybutyl methacrylates, polyvinyl chlorides, polyvinyl acetates, polyethylenes, polypropylenes, epoxy resins, epoxy polyol resins, polyurethanes, polyamides, polyvinyl butyrals, polyacrylic acid resins, rosin, modified rosins, terpene resins, aliphatic or alicyclic hydrocarbon resins, aromatic petroleum resins, chlorinated paraffins and paraffin waxes. These resins may be used alone or in combination.

Examples of the polymers of a substituted or unsubstituted styrene include polyesters, polystyrenes, poly(p-chlorostyrenes) and polyvinyltoluenes. Examples of the styrene copolymers include styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers.

The masterbatch can be prepared by mixing or kneading a colorant with the resin for use in the masterbatch through application of high shearing force. Preferably, an organic solvent may be used for improving the interactions between the colorant and the resin. Further, a so-called flashing method is preferably used, since a wet cake of the colorant can be directly used, i.e., no drying is required. Here, the flashing method is a method in which an aqueous paste containing a colorant is mixed or kneaded with a resin and an organic solvent, and then the colorant is transferred to the resin to remove the water and the organic solvent. In this mixing or kneading, for example, a high-shearing disperser (e.g., a three-roll mill) is preferably used. The colorant may be incorporated into any of a first resin phase and a second resin phase by utilizing the difference in affinity to the two resins. As has been known well, when exists in the surface of the toner, the colorant degrades charging performance of the toner. Thus, by selectively incorporating the colorant into the first resin phase which is the inner layer, the formed toner can be improved in charging performances (e.g., environmental stability, charge retainability and charging amount).

—Releasing Agent—

The releasing agent is not particularly limited and may be appropriately selected depending on the intended purpose. The melting point thereof is preferably low; i.e., 50° C. to 120° C. When dispersed together with a resin, such a low-melting-point releasing agent effectively exhibits its releasing effects on the interface between a fixing roller and each toner particle. Thus, even when an oil-less mechanism is employed (in which a releasing agent such as oil is not applied onto a fixing roller), excellent hot offset resistance is attained.

Preferred examples of the releasing agent include waxes.

Examples of the waxes include natural waxes such as vegetable waxes (e.g., carnauba wax, cotton wax, Japan wax and rice wax), animal waxes (e.g., bees wax and lanolin), mineral waxes (e.g., ozokelite and ceresine) and petroleum waxes (e.g., paraffin waxes, microcrystalline waxes and petrolatum); synthetic hydrocarbon waxes (e.g., Fischer-Tropsch waxes and polyethylene waxes); and synthetic waxes (e.g., ester waxes, ketone waxes and ether waxes). Further examples include fatty acid amides such as 12-hydroxystearic acid amide, stearic amide, phthalic anhydride imide and chlorinated hydrocarbons; low-molecular-weight crystalline polymer resins such as acrylic homopolymers (e.g., poly-n-stearyl methacrylate and poly-n-lauryl methacrylate) and acrylic copolymers (e.g., n-stearyl acrylate-ethyl methacrylate copolymers); and crystalline polymers having a long alkyl group as a side chain. These releasing agents may be used alone or in combination.

The melting point of the releasing agent is not particularly limited and may be appropriately selected depending on the intended purpose. The melting point is preferably 50° C. to 120° C., more preferably 60° C. to 90° C. When the melting point is lower than 50° C., the wax may adversely affect the heat-resistant storage stability of the toner. When the melting point is higher than 120° C., cold offset is easily caused upon fixing at lower temperatures.

The melt viscosity of the releasing agent is not particularly limited and may be appropriately selected depending on the intended purpose. In the case where the melt viscosity of the releasing agent is measured at the temperature 20° C. higher than the melting point of the wax, it is preferably 5 cps to 1,000 cps, more preferably 10 cps to 100 cps. When the melt viscosity is lower than 5 cps, the formed toner may degrade in releasing ability. When the melt viscosity is higher than 1,000 cps, the hot offset resistance and the low-temperature fixing property may not be improved.

The amount of the releasing agent contained in the toner is not particularly limited and may be appropriately selected depending on the intended purpose. The amount of the releasing agent is preferably 0% by mass to 40% by mass, more preferably 3% by mass to 30% by mass. When the amount is higher than 40% by mass, the formed toner may be degraded in flowability.

The releasing agent may be incorporated into any of a resin inside the toner base particles (first resin phase) and a resin of fine resin particles (second resin phase) by utilizing the difference in affinity to the two resins. By selectively incorporating the releasing agent into the second resin phase which is the outer layer of the toner, the releasing agent oozes out satisfactorily in a short heating time in the fixation and, consequently, satisfactory releasability can be realized. On the other hand, by selectively incorporating the releasing agent into the first resin phase which is the inner layer, the spent of the releasing agent to other members such as the photoconductors and carriers can be suppressed. In the method for producing a toner of the present invention, the arrangement of the releasing agent is sometimes freely designed and the releasing agent may be arbitrarily arranged according to various image forming processes.

—Charge Controlling Agent—

The charge controlling agent is not particularly limited and may be appropriately selected from those known in the art. Examples thereof include nigrosine dyes, triphenylmethane dyes, chrome-containing metal complex dyes, molybdic acid chelate pigments, rhodamine dyes, alkoxy amines, quaternary ammonium salts (including fluorine-modified quaternary ammonium salts), alkylamides, phosphorus, phosphorus compounds, tungsten, tungsten compounds, fluorine-based active agents, metal salts of salicylic acid, and metal salts of salicylic acid derivatives. These may be used alone or in combination.

Also, the charge controlling agent may be a commercially available product. Examples thereof include BONTRON 03 (nigrosine dye), BONTRON P-51 (quaternary ammonium salt), BONTRON S-34 (metal azo-containing dye), E-82 (oxynaphthoic acid-based metal complex), E-84 (salicylic acid-based metal complex) and E-89 (phenol condensate) (these are manufactured by ORIENT CHEMICAL INDUSTRIES CO., LTD); TP-302 and TP-415 (quaternary ammonium salt molybdenum complex (these are manufactured by Hodogaya Chemical Co., Ltd.)); COPY CHARGE PSY VP 2038 (quaternary ammonium salt), COPY BLUE PR (triphenylmethane derivative), COPY CHARGE NEG VP2036 (quaternary ammonium salt) and COPY CHARGE NX VP434 (these are manufactured by Hoechst AG); LRA-901 and LR-147 (boron complex) (these are manufactured by Japan Carlit Co., Ltd.); copper phthalocyanine; perylene; quinacridone; azo pigments; and polymeric compounds having, as a functional group, a sulfonic acid group, carboxyl group, quaternary ammonium salt, etc.

The charge controlling agent may be incorporated into any of a resin phase inside the toner base particles and a resin phase of fine resin particles by utilizing the difference in affinity to the two resins. By selectively incorporating the charge controlling agent into the resin phase of the fine resin particles which is present on a toner surface, charging effect can be easily obtained by a small amount of the charge controlling agent. On the other hand, when the charge controlling agent is selectively contained in the resin phase inside the toner base particles present in the inner layer, the spent of the charge controlling agent to other members such as the photoconductors and carriers can be suppressed. In the method for producing a toner of the present invention, the arrangement of the charge controlling agent is sometimes freely designed and the charge controlling agent may be arbitrarily arranged according to various image forming processes.

The amount of the charge controlling agent in the toner is determined depending on types of the resin, presence or absence of additives, and a dispersion method, and therefore cannot be uniquely determined. However, the amount of charge controlling agent is preferably 0.1 parts by mass to 10 parts by mass, and more preferably 0.2 parts by mass to 5 parts by mass based on 100 parts by mass of the binder resin. When the amount is less than 0.1 parts by mass, the charge controlling ability may no be obtained; when the amount is more than 10 parts by mass, the formed toner has excessively high charging ability, resulting in that the charge controlling agent cannot sufficiently exhibit its effect. As a result, the electrostatic force increases between the developing roller and the toner, possibly decreasing the fluidity of the toner or forming an image with reduced color density.

—Fine Inorganic Particles—

The fine inorganic particles are used as an external additive for imparting, for example, fluidity, developability and charging ability to the toner particles. The fine inorganic particles are not particularly limited and may be appropriately selected depending on the intended purpose. Examples thereof include silica, alumina, titanium oxide, barium titanate, magnesium titanate, calcium titanate, strontium titanate, zinc oxide, tin oxide, silica sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide and silicon nitride. These fine inorganic particles may be used alone or in combination.

In addition to fine inorganic particles having a large particle diameter of 80 nm to 500 nm in terms of primary average particle diameter, fine inorganic particles having a small particle diameter can be preferably used as fine inorganic particles for assisting the fluidity, developability, and charging ability of the toner. In particular, hydrophobic silica and hydrophobic titanium oxide are preferably used as the fine inorganic particles having a small particle diameter.

The primary average particle diameter of the fine inorganic particles is preferably 5 nm to 50 nm, more preferably 10 nm to 30 nm.

The BET specific surface area of the fine inorganic particles is preferably 20 $m^2/g$ to 500 $m^2/g$.

The amount of the fine inorganic particles contained in the toner is preferably 0.01% by mass to 5% by mass, more preferably 0.01% by mass to 2.0% by mass.

—Flowability Improver—

The flowability improver is an agent applying surface treatment to improve hydrophobic properties, and is capable of inhibiting the degradation of flowability or charging ability under high humidity environment. Specific examples of the flowability improver include silane coupling agents, silylation agents, silane coupling agents having a fluorinated alkyl group, organotitanate coupling agents, aluminum coupling agents, silicone oils, and modified silicone oils. It is preferable that the silica and titanium oxide (fine inorganic particles) be subjected to surface treatment with such a flowability improver and used as hydrophobic silica and hydrophobic titanium oxide.

—Cleanability Improver—

The cleanability improver is an agent added to the toner to remove the developer remaining on a photoconductor or a primary transfer member after transfer. Specific examples of the cleanability improver include metal salts of fatty acids such as stearic acid (e.g., zinc stearate and calcium stearate), fine polymer particles formed by soap-free emulsion polymerization, such as fine polymethylmethacrylate particles and fine polyethylene particles. The fine polymer particles preferably have a relatively narrow particle size distribution. It is preferable that the volume average particle diameter thereof be 0.01 μm to 1 μm.

—Magnetic Material—

The magnetic material is not particularly limited and may be appropriately selected from those known in the art depending on the intended purpose. Examples thereof include iron powder, magnetite and ferrite. Among these, one having a white color is preferable in terms of color tone.

<Method for Measuring Toner Properties>

Hereinafter, a method for measuring properties of the toner of the present invention will be described.

—Charge Amount—

The charge amount of the toner is measured with a V blow-off device (manufactured by RICOH SOZO KAIHATSU K.K.). The toner and the carrier are allowed to stand as a developer having a toner concentration of 7% by mass at a predetermined environment (temperature and humidity) for 2 hr. The developer is then placed in a metallic gauge, followed by mixing with stirring in a stirring device at 280 rpm for 600 sec. One gram of the developer is weighed from 6 g of the initial developer, and the charge amount distribution of the toner is measured by a single mode method with a V blow-off device (manufactured by RICOH SOZO KAIHATSU K.K.). At the time of blow, an opening of 635 mesh is used. In the single mode method of the V blow-off device (manufactured by RICOH SOZO KAIHATSU K.K.), a single mode is selected according to the instruction manual, and measurement is performed under the following conditions: 5 mm in height, suction 100, and blow twice.

<Weight Average Particle Diameter (Dw), Volume Average Particle Diameter (Dv) and Number Average Particle Diameter (Dn)>

The weight average particle diameter (Dw), the volume average particle diameter (Dv) and the number average particle diameter (Dn) of the toner can be measured as follows. Specifically, using a particle size analyzer ("MULTISIZER III," manufactured by Beckman Coulter Inc.) with the aperture diameter being set to 100 μm, and the obtained measurements are analyzed with an analysis software (Beckman Coulter MULTISIZER 3 Version 3.51). More specifically, 0.5 mL of a 10% by mass surfactant (alkylbenzene sulfonate, Neogen SC-A, manufactured by Daiichi Kogyo Seiyaku Co., Ltd.) is charged to a 100 mL-glass beaker, and 0.5 g of a toner sample is added thereto, followed by stirring with a microspatula. Subsequently, 80 mL of ion-exchanged water is added to the beaker. The obtained dispersion liquid is subjected to dispersion treatment for 10 min using an ultrasonic wave dispersing device (W-113MK-II, manufactured by Honda Electronics Co., Ltd.). The resultant dispersion liquid is measured using MULTISIZER III and ISOTON III (manufactured by Beckman Coulter Inc.) serving as a solution for measurement. The dispersion liquid containing the toner sample is dropped so that the concentration indicated by the meter falls within a range of 8%±2%. In this measuring method, it is important in terms of reproducibility of measuring the particle size that the concentration is adjusted to the range of 8%±2%. When the concentration indicated by the meter falls within the range of 8%±2%, no error is occurred in the measurement of the particle size.

—Average Circularity—

The average circularity of the toner is defined by the following equation.

Average circularity SR=(Circumferential length of a circle having the same area as projected particle area/Circumferential length of projected particle image)×100 (%)

The average circularity of the toner is measured using a flow-type particle image analyzer ("FPIA-2100," manufactured by SYSMEX CORPORATION), and analyzed using an analysis software (FPIA-2100 Data Processing Program for FPIA Version00-10). Specifically, into a 100 mL glass beaker, 0.1 mL to 0.5 mL of a 10% by mass surfactant (NEOGEN SC-A, an alkylbenzene sulfonate, manufactured by Dai-ichi Kogyo Seiyaku Co., Ltd.) is charged, and 0.1 g to 0.5 g of a toner is added, followed by stirring with a microspatula. Subsequently, 80 mL of ion-exchanged water is added to the beaker. The obtained dispersion liquid is subjected to dispersion treatment for 3 min using an ultrasonic wave dispersing device (manufactured by Honda Electronics Co., Ltd.). Using FPIA-2100, the shape and distribution of toner particles are measured until the dispersion liquid has a concentration of 5,000 number per μL to 15,000 number per μL.

In this measuring method, it is important in terms of reproducibility in measuring the average circularity that the concentration of the dispersion liquid is adjusted to the range of 5,000 number per μL to 15,000 number per μL. To obtain the above-mentioned concentration of the dispersion liquid, it is necessary to change the conditions of the dispersion liquid, namely the amounts added of the surfactant and of the toner. The required amount of the surfactant varies depending on the hydrophobicity of the toner, similar to the measurement of the toner particle diameter. When the surfactant is added in large amounts, noise is caused by foaming. When the surfactant is added in small amounts, the toner cannot be sufficiently wetted, leading to insufficient dispersion. Also, the amount of the toner added varies depending on its particle diameter. When the toner has a small particle diameter, it needs to be added in small amounts. When the toner has a large particle diameter, it needs to be added in large amounts. In the case where the toner particle diameter is 3 μm to 7 μm, the dispersion liquid concentration can be adjusted to the range of 5,000 number per μL to 15,000 number per μL by adding 0.1 g to 0.5 g of the toner.

—BET Specific Surface Area—

The BET specific surface area of the toner is measured with an automatic specific surface area/pore distribution measuring device TRISTAR 3000 (manufactured by SHIMADZU CORPORATION). One gram of the toner is placed in a dedicated cell, and the inside of the dedicated cell is degassed using a degassing dedicated unit for TRISTAR, VACUPREP 061 (manufactured by SHIMADZU CORPORATION). The degassing treatment is carried out at room temperature at least for 20 hr under the condition of reduced pressure at equal to or less than 100 mtorr. The dedicated cell subjected to the degassing treatment can be automatically subjected to the BET specific surface area measurement with TRISTAR 3000. Nitrogen gas is used as absorbing gas.

—Nanoindentation Method—

When the hardness of the surface of one toner particle is measured by the nanoindentation method, a TRIBO-INDENTER manufactured by HYSITRON INC. is used. Detailed conditions are as follows.

Indenter used: Berkovich (triangular pyramid)

Maximum indentation depth: 20 nm

Under the above conditions, the indenter is indented from the surface of the one toner particle, and the hardness H [GPa] is measured from the size of the dent at the maximum indentation. In actual measurement, the hardness is measured for 100 toner particles in a product form (for one particle, the hardness is measured at N=10 with varied measurement sites followed by averaging of the measured values), and the data are averaged to determine the hardness of the one toner particle as measured by the nanoindentation method.

—Microindentation Method—

When the hardness of the surface of one toner particle is measured by the microindentation method, FISCHERSCOPE H100 (a microhardness testing system, manufactured by Fischer Instruments K.K. is used. Detailed conditions are as follows.

Indenter used: Vickers indenter

Maximum indentation depth: 2 μm

Maximum indentation load: 9.8 mN

Creep time: 5 sec

Loading (unloading) time: 30 sec

Under the above conditions, the Vickers indenter is indented from the surface of the one toner particle to measure Martens hardness [N/mm$^2$]. In actual measurement, the hardness is measured for 100 toner particles in a product form and the data are averaged to determine the hardness of the one toner particle as measured by the microindentation method.

<Method for Measuring Carrier Properties>

The carrier properties can be measured in the following manner.

—Weight Average Particle Diameter—

The weight average particle diameter (Dw) of the carrier is calculated on the basis of the particle size distribution of the particles measured on a number basis; i.e., the relation between the number based frequency and the particle diameter. In this case, the weight average particle diameter (Dw) is expressed by Equation (1):

$$Dw=\{1/\Sigma(nD^3)\}\times\{\Sigma(nD^4)\} \quad \text{Equation (1)}$$

in Equation (1) D represents a typical particle diameter (μm) of particles present in each channel, and "n" represents the total number of particles present in each channel. It should be noted that each channel is a length for equally dividing the range of particle diameters in the particle size distribution chart, and 2 μm is employed for each channel in the present invention. For the typical particle diameter of particles present in each channel, the minimum particle diameter of the particles present in each channel can be employed.

In addition, the number average particle diameter (Dp) of the carrier or the core material particles are calculated on the basis of the particle diameter distribution measured on a number basis. The number average particle diameter (Dp) is expressed by Equation (2):

$$Dp=(1/\Sigma N)\times(\Sigma nD) \quad \text{Equation (2)}$$

in Equation (2) N represents the total number of particles measured, "n" represents the total number of particles present in each channel and D represents the minimum particle diameter of the particles present in each channel (2 μm).

For a particle size analyzer used for measuring the particle size distribution, a micro track particle size analyzer (Model HRA9320-X100, manufactured by Honewell Co.) may be used. The evaluation conditions are as follows.

(1) Range of particle diameters: 8 μm to 100 μm (2) Channel length (width): 2 μm (3) Number of channels: 46

(4) Refraction index: 2.42

(Full-Color Image Forming Method)

The full-color image forming method of the present invention includes a charging step of charging an electrophotographic photoconductor using a charging unit, an exposing step of forming a latent electrostatic image on the charged electrophotographic photoconductor using an exposing unit, a developing step of developing the latent electrostatic image with a toner using a developing step containing the toner so as to form a toner image on the electrophotographic photoconductor, a primary transfer step of primarily transferring the toner image formed on the electrophotographic photoconductor onto an intermediate transfer medium using a primary transfer unit, a secondary transfer step of secondarily transferring the toner image, which has been transferred onto the intermediate transfer medium, onto a recording medium using a secondary transfer unit, a fixing step of fixing the toner image on the recording medium using a fixing unit including a heat and pressure-applying member, and a cleaning step of cleaning the toner remaining and adhering onto a surface of the electrophotographic photoconductor, from which the toner image has been transferred to the intermediate transfer medium using the primary transfer unit, using a cleaning unit, and if necessary further includes other steps.

The toner used in the developing step is the toner of the present invention.

In the full-color image forming method, in the secondary transfer step, the linear velocity of transferring the toner image onto the recording medium, so-called printing speed, is not particularly limited and may be appropriately selected depending on the intended purpose. It is preferably 100 mm/sec to 1,000 mm/sec, and more preferably 300 mm/sec to 1,000 mm/sec.

In the full-color image forming method, in the secondary transfer step the transfer time at a nip portion in the secondary transfer unit is preferably 0.5 msec to 60 msec, more preferably 0.5 msec to 20 msec.

Further, the full-color image forming apparatus according to the present invention is preferably of a tandem type including a plurality of sets of an electrophotographic photoconductor, a charging unit, an exposing unit, a developing unit, a primary transfer unit, and a cleaning unit. In the so-called tandem type in which a plurality of electrophotographic photoconductors are provided, and development is carried out one color by one color upon each rotation, a latent electrostatic image formation step and a development and transfer step are carried out for each color to form each color toner image. Accordingly, the difference in speed between single color image formation and full color image formation is so small that the tandem type can advantageously apply to high-speed printing. In this case, the color toner images are formed on respective separate electrophotographic photoconductors, and the color toner layers are stacked (color superimposition) to form a full color image. Accordingly, when a variation in properties, for example, a difference, for example, in charging ability between color toner particles exists, a difference in amount of the development toner occurs between the individual color toner particles. As a result, a change in hue of secondary color by color superimposition is increased, and the color reproducibility is lowered.

It is necessary for the toner used in the tandem image forming method to satisfy the requirements that the amount of the developing toner for regulating the balance of the colors is stabilized (no variation in developing toner amount between respective color toner particles), and the adherence to the electrophotographic photoconductor and to the recording medium is uniform between the respective color toner particles. With respect to these points, the toner of the present invention is preferable.

<Electrophotographic Photoconductor>

The electrophotographic photoconductor is not particularly limited and may be appropriately selected depending on the intended purpose. For example, an exemplary electrophotographic photoconductor includes at least a conductive support, a photosensitive layer, and a surface layer, and if necessary further includes other constitutions.

<Charging Step>

The charging step is not particularly limited as long as the electrophotographic photoconductor is charged by using the charging unit, and may be appropriately selected depending on the intended purpose.

The charging step is not particularly limited and may be appropriately selected depending on the intended purpose, but the charging unit preferably applies at least an alternating voltage superimposed on direct voltage. The application of the alternating voltage superimposed on direct voltage can stabilize the surface voltage of the electrophotographic photoconductor to a desired value as compared with the application of only a direct current voltage. Accordingly, further uniform charging can be realized.

The charging unit preferably performs charging by bringing a charging member into contact with the electrophotographic photoconductor and applying the voltage to the charging member. When charging is carried out by bringing the charging member into contact with the electrophotographic photoconductor and applying the voltage to the charging member, the effect of uniform charging ability attained by applying the alternating voltage superimposed on direct voltage can be further improved.

Figure 2:
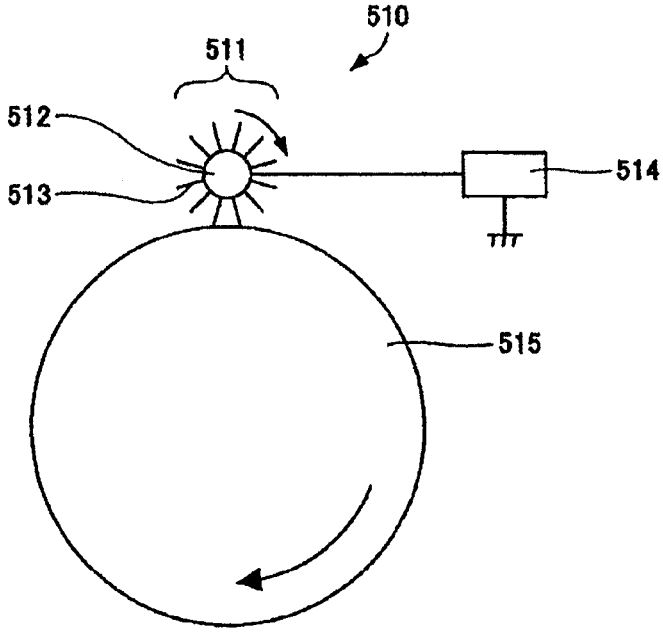
FIG. 2 is a schematic view of one exemplary contact-type brush charging device.

The charging unit used in the charging step may be a contact charging device, such as a roller-type charging device illustrated in FIG. 1, a brush-type charging device illustrated in FIG. 2, or the like.

—Roller-Type Charging Device—

FIG. 1 is a schematic configuration of an example of a roller-type charging device 500 which is one type of contact charging devices. A photoconductor (electrophotographic photoconductor) 505 to be charged as an image bearing member is rotated at a predetermined speed (process speed) in the direction indicated by the arrow. A charging roller 501 serving as a charging member, which is brought into contact with the photoconductor 505, contains a metal core 502 and a conductive rubber layer 503 formed on the outer surface of the metal core 502 in a shape of a concentric circle, as a basic structure. The both terminals of the metal core 502 are supported with bearings (not shown) so that the charging roller enables to rotate, and the charging roller is pressed against the photoconductor drum at a predetermined pressure by a pressurizing unit (not shown). The charging roller 501 in FIG. 1 therefore rotates along with the rotation of the photoconductor 505. The charging roller 501 is generally formed with a diameter of 16 mm in which a metal core 502 having a diameter of 9 mm is coated with a conductive rubber layer 503 having a moderate resistance of approximately 100,000 Ω·cm. The power supply 504 shown in the figure is electrically connected to the metal core 502 of the charging roller 501, and a predetermined bias is applied to the charging roller 501 by the power supply 504. Thus, the surface of the photoconductor 505 is uniformly charged at a predetermined polarity and potential.

—Fur Brush Charging Device—

In addition to the roller-type charging device, the charging device may be any form, such as a magnetic brush charging device, a fur brush charging device, or the like. It may be suitably selected according to a specification or configuration of an electrophotographic apparatus. When the magnetic brush charging device is used as the charging device, the magnetic brush includes a charging member formed of various ferrite particles such as Zn—Cu ferrite, etc., a non-magnetic conductive sleeve to support the ferrite particles, and a magnetic roller included in the non-magnetic conductive sleeve. Moreover, in the case of using the fur brush charging device, a material of the fur brush is, for example, a fur treated to be conductive with, for example, carbon, copper sulfide, a metal or a metal oxide, and the fur is coiled or mounted to a metal or another metal core which is treated to be conductive, thereby obtaining the charging device.

FIG. 2 is a schematic configuration of one example of a contact brush charging device 510. A photoconductor (electrophotographic photoconductor) 515 to be charged (image bearing member) is rotatably driven at a predetermined speed (process speed) in the direction indicated by the arrow. The fur brush roller 511 having a fur brush is brought into contact with the photoconductor 515, with a predetermined nip width and a predetermined pressure with respect to elasticity of a brush part 513.

The fur brush roller 511 as the contact charging device has an outer diameter of 14 mm and a longitudinal length of 250 mm. In this fur brush, a tape formed of a pile of conductive rayon fiber REC-B (manufactured by Unitika Ltd.), as a brush part 513, is spirally coiled around a metal core 512 having a diameter of 6 mm, which serves also as an electrode. A brush of the brush part 513 is of 300 denier/50 filament, and a density of 155 fibers per 1 square millimeter. This role brush is once inserted into a pipe having an internal diameter of 12 mm with rotating in a certain direction, and is set so as to be a concentric circle relative to the pipe. Thereafter, the role brush in the pipe is left in an atmosphere of high humidity and high temperature so as to twist the fibers of the fur.

The resistance of the fur brush roller 511 is $1\times10^5\Omega$ at an applied voltage of 100 V. This resistance is calculated from the current obtained when the fur brush roller is contacted with a metal drum having a diameter of 30 mm with a nip width of 3 mm, and a voltage of 100 V is applied thereon. The resistance of the brush charging device 510 should be $10^4\Omega$ or more in order to prevent image defect caused by an insufficient charge at the charging nip part when the photoconductor 515 to be charged happens to have defects caused by low pressure resistance, such as pin holes thereon and an excessive leak current therefore runs into the defects. Moreover, the resistance needs to be $10^7\Omega$ or less in order to sufficiently charge the surface of the photoconductor 515.

Examples of the material of the fur brush include, in addition to REC-B (manufactured by Unitika Ltd.), REC-C, REC-M1, REC-M10 (manufactured by Unitika Ltd.), SA-7 (manufactured by Toray Industries, Inc.), THUNDERON (manufactured by Nihon Sanmo Dyeing Co., Ltd.), BELTRON (manufactured by Kanebo Gohsen, Ltd.), KURACARBO in which carbon is dispersed in rayon (manufactured by Kuraray Co., Ltd.), and ROVAL (manufactured by Mitsubishi Rayon Co., Ltd.). The brush is of preferably 3 denier to 10 denier per fiber, 10 filaments per bundle to 100 filaments per bundle, and 80 fibers/$mm^2$ to 600 fibers/$mm^2$. The length of the fur is preferably 1 mm to 10 mm.

The fur brush roller 511 is rotatably driven in the opposite (counter) direction to the rotation direction of the photoconductor 515 at a predetermined peripheral velocity (surface velocity), and comes into contact with a surface of the photoconductor with a velocity difference. The power supply 514 applies a predetermined charging voltage to the fur brush roller 511 so that the surface of the photoconductor is uniformly charged at a predetermined polarity and potential.

The contact charge of the photoconductor 515 with the fur brush roller 511 is performed in the following manner: charges are mainly directly injected and the surface of the photoconductor is charged at the substantially equal voltage to the applying charging voltage to the fur brush roller 511.

The charging member is not limited in its shape and may be in any shape such as a charging roller or a fur blush, as well as the fur blush roller 511. The shape can be selected according to the specification and configuration of the image forming apparatus. When a charging roller is used, it generally includes a metal core and a rubber layer having a moderate resistance of about 100,000 Ω·cm coated on the metal core. When a magnetic fur blush is used, it generally includes a charging member formed of various ferrite particles such as Zn—Cu ferrite, a non-magnetic conductive sleeve to support the ferrite particles, and a magnet roll included in the non-magnetic conductive sleeve.

As a contact charging member, one example of the magnetic brush will be described. The magnetic brush as the contact charging member is formed of magnetic particles. For the magnetic particles, Zn—Cu ferrite particles having an average particle diameter of 25 μm and Zn—Cu ferrite particles having an average particle diameter of 10 μm are mixed together in a ratio by mass of 1:0.05, so as to obtain ferrite particles having an average particle diameter of 25 μm, which have peaks at each average particle diameter, and then the ferrite particles are coated with a resin layer having a moderate resistance, to thereby form magnetic particles. The contact charging member is formed of the aforementioned coated magnetic particles, a non-magnetic conductive sleeve which supports the coated magnetic particles, and a magnet roller which is included in the non-magnetic conductive sleeve. The coated magnetic particles are disposed on the sleeve with a thickness of 1 mm so as to form a charging nip of about 5 mm-wide with the photoconductor. The width between the non-magnetic conductive sleeve and the photoconductor is adjusted to approximately 500 μm. The magnetic roller is rotated so that the non-magnetic conductive sleeve is rotated at twice in speed relative to the peripheral speed of the surface of the photoconductor in the opposite direction of the rotation of the photoconductor, to thereby slidingly rub the photoconductor. Therefore, the magnetic brush is uniformly brought into contact with the photoconductor.

<Exposing Step>

The exposing step is not particularly limited, as long as it can form a latent electrostatic image on the charged surface of the electrophotographic photoconductor using an exposing unit, and may be appropriately selected depending on the intended purpose.

The exposing unit is not particularly limited and may be appropriately selected depending on the intended purpose. Examples thereof include a radiation optical system, a rod lens array, a laser optical system, a liquid crystal shutter optical system, and a LED optical system.

<Developing Step>

The developing unit is not particularly limited as long as it can develop a latent electrostatic image with a toner using a developing unit containing the toner so as to form a toner image on the electrophotographic photoconductor, and may be appropriately selected depending on the intended purpose.

The developing unit is not particularly limited, and may be appropriately selected depending on the intended purpose. Examples thereof include a developing unit containing a toner and/or a developer, and capable of supplying the toner and/or the developer to the latent electrostatic image in a contact or noncontact manner.

Figure 3:
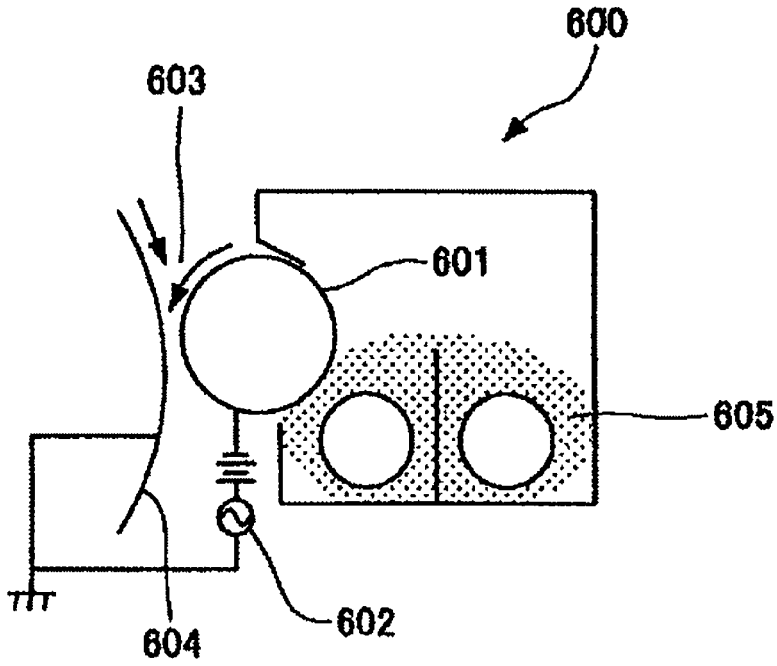
FIG. 3 is a schematic view of one exemplary developing device.

When a latent electrostatic image on a photoconductor of the present invention is developed, an alternating electrical field is preferably applied. In a developing device 600 illustrated shown in FIG. 3, a power supply 602 applies a vibration bias voltage as developing bias, in which a direct-current voltage and an alternating voltage are superimposed, to a developing sleeve 601 during development. The potential of background part and the potential of image part are positioned between the maximum and the minimum of the vibration bias potential. This forms an alternating electrical field, whose direction alternately changes, at a developing region 603. A toner and a carrier in the developer are intensively vibrated in this alternating electrical field, so that the toner 605 is released from electrostatic constraint force with respect to the developing sleeve 601 and the carrier, and is attached to a latent electrostatic image on the photoconductor 604. The toner 605 is a toner produced by the method for producing a toner of the present invention.

The difference between the maximum and the minimum of the vibration bias voltage (peak-to-peak voltage) is preferably from 0.5 kV to 5 kV, and the frequency is preferably from 1 kHz to 10 kHz. The waveform of the vibration bias voltage may be a rectangular wave, a sine wave or a triangular wave. The direct-current voltage of the vibration bias voltage is in a range between the potential of the background part and the potential of the image part as mentioned above, and is preferably set closer to the potential of the background from the viewpoint of inhibiting a toner deposition (fogging) on the area of the potential of the background.

When the vibration bias voltage is a rectangular wave, it is preferred that a duty ratio be 50% or less. The duty ratio is a ratio of time when the toner leaps to the photoconductor during a cycle of the vibration bias. In this way, the difference between the peak time value when the toner leaps to the photoconductor and the time average value of bias can become very large. Consequently, the movement of the toner becomes further activated hence the toner is accurately attached to the potential distribution of the latent electrostatic image and rough deposits and an image resolution can be improved. Moreover, the difference between the time peak value when the carrier having an opposite polarity of current to the toner leaps to the photoconductor and the time average value of bias can be decreased. Consequently the movement of the carrier can be restrained and the possibility of the carrier adhesion onto the background part can be largely reduced.

<Primary Transfer Step>

The primary transfer unit is not particularly limited as long as the toner image formed on the electrophotographic photoconductor is transferred onto an intermediate transfer medium using the primary transfer unit, and may be appropriately selected depending on the intended purpose.

The primary transfer unit is not particularly limited, and may be appropriately selected depending on the intended purpose. Examples thereof include a corona transfer device using corona discharge, a transfer belt, a transfer roller, a pressing transfer roller, and an adhesion transfer device.

<Secondary Transfer Step>

The secondary transfer step is not particularly limited as long as the toner image transferred onto the intermediate transfer medium is transferred to a recording medium using the secondary transfer unit, and may be appropriately selected depending on the intended purpose.

The secondary transfer unit is not particularly limited, and may be appropriately selected depending on the intended purpose. Examples thereof include a corona transfer device using corona discharge, a transfer belt, a transfer roller, a pressing transfer roller, and an adhesion transfer device.

<Fixing Step>

The fixing step is not particularly limited as long as the toner image transferred onto the recording medium is fixed on the recording medium using the fixing unit containing a heat and pressure-applying member, and may be appropriately selected depending on the intended purpose.

The fixing unit is not particularly limited and may be appropriately selected depending on the intended purpose. The fixing unit including a heating roller that is formed of a magnetic metal and is heated by electromagnetic induction; a fixation roller disposed parallel to the heating roller; an endless belt-like toner heating medium (a heating belt) that is stretched around the heating roller and the fixation roller and rotated by these rollers, while being heated by the heating roller; and a pressure roller that is brought into pressure contact with the fixation roller through the heating belt and is rotated in a forward direction relative to the heating belt to form a fixation nip part. The fixing step can realize a temperature rise in the fixation belt in a short time and can realize stable temperature control. Further, even when a recording medium having a rough surface is used, during the fixation, the fixation belt acts in conformity to the surface of the transfer paper to some extent and, consequently, satisfactory fixability can be realized.

The fixing unit is preferably of an oil-less type or a minimal oil-coated fixing type. To this end, preferably, the toner particles to be fixed contain a releasing agent (wax) in a finely dispersed state in the toner particles. In the toner in which a releasing agent is finely dispersed in the toner particle, the releasing agent is likely to ooze out during fixation. Accordingly, in the oil-less fixing device or even when an oil coating effect becomes unsatisfactory in the minimal oil-coated fixing device, the transfer of the toner to the belt can be suppressed. In order that the releasing agent is present in a dispersed state in the toner particle, preferably, the releasing agent and the binder resin are not compatible with each other. The releasing agent can be finely dispersed in the toner particle, for example, by taking advantage of the shear force of kneading during the toner production. The dispersion state of the releasing agent can be determined by observing a thin film section of the toner particle under a TEM. The dispersion diameter of the releasing agent is not particularly limited but is preferably small. However, when the dispersion diameter is excessively small, the releasing agent may not be sufficiently oozed out during the fixation. Accordingly, when the releasing agent can be observed at a magnification of 10,000 times, it can be determined that the releasing agent is present in a dispersed state. When the releasing agent is so small that the releasing agent cannot be observed at a magnification of 10,000 times, the releasing agent may not be sufficiently oozed out during the fixation even when the releasing agent is finely dispersed in the toner particle.

Figure 4:
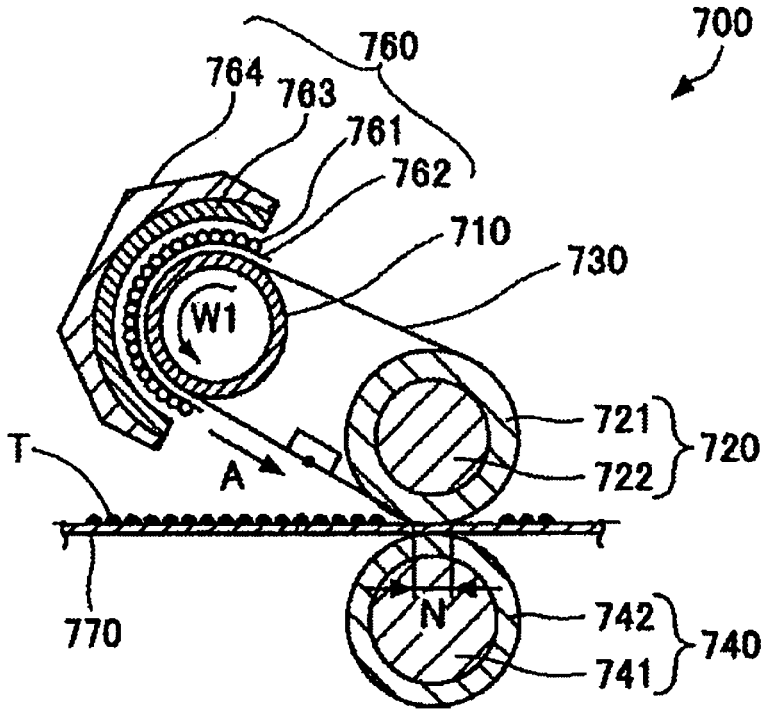
FIG. 4 is one exemplary schematic view of a fixing device.

The fixing device (fixing unit) used in the image forming method of the present invention may be a fixing device shown in FIG. 4. The fixing device 700 shown in FIG. 4 preferably includes a heating roller 710 which is heated by electromagnetic induction by means of an induction heating unit 760, a fixing roller 720 (facing rotator) disposed in parallel to the heating roller 710, a fixing belt (heat resistant belt, toner heating medium) 730, which is formed of an endless strip stretched between the heating roller 710 and the fixing roller 720 and which is heated by the heating roller 710 and rotated by means of any of these rollers in the direction indicated by an arrow A, and a pressure roller 740 (pressing rotator) which is pressed against the fixing roller 720 through the fixing belt 730 and which is rotated in forward direction with respect to the fixing belt 730.

The heating roller 710 is a hollow cylindrical magnetic metal member made of, for example, iron, cobalt, nickel or an alloy of these metals. The heating roller 710 is 20 mm to 40 mm in an outer diameter, and 0.3 mm to 1.0 mm in thickness, to be in construction of low heat capacity and a rapid rise of temperature.

The fixing roller 720 (facing rotator) is formed of a metal core 722 made of metal such as stainless steel, and an elastic member 721 made of a solid or foam-like silicone rubber having heat resistance to be coated on the metal core 722. Further, to form a contact section of a predetermined width between the pressure roller 740 and the fixing roller 720 by a compressive force provided by the pressure roller 740, the fixing roller 720 is constructed to be about 20 mm to about 40 mm in an outer diameter to be larger than the heating roller 710. The elastic member 721 is about 4 mm to about 6 mm in thickness. Owing to this construction, the heat capacity of the heating roller 710 is smaller than that of the fixing roller 720, so that the heating roller 710 is rapidly heated to make warm-up time period shorter.

The fixing belt 730 that is stretched between the heating roller 710 and the fixing roller 720 is heated at a contact section W1 with the heating roller 710 to be heated by the induction heating unit 760. Then, an inner surface of the fixing belt 730 is continuously heated by the rotation of the heating roller 710 and the fixing roller 720, and as a result, the whole belt will be heated.

Figure 5:
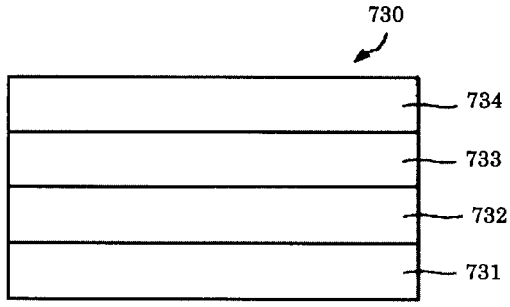
FIG. 5 shows one exemplary layer structure of a fixing belt.

FIG. 5 shows a layer structure of the fixing belt 730. The fixing belt 730 consists of the following four layers in the order from an inner layer to a surface layer.

Substrate 731: a resin layer, for example, formed of a polyimide (PI) resin

Heat generating layer 732: a conductive material layer, for example, formed of Ni, Ag, SUS Intermediate layer 733: an elastic layer for uniform fixation Release layer 734: a resin layer, for example, formed of a fluorine-containing resin material for obtaining releasing effect and making oilless.

The release layer 734 is preferably about 10 μm to about 300 μm in thickness, particularly preferably about 200 μm in thickness. In this manner, in the fixing device 700 as shown in FIG. 4, since the surface layer of the fixing belt 730 sufficiently covers a toner image T formed on a recording medium 770, it becomes possible to uniformly heat and melt the toner image T. The release layer 734; i.e., a surface release layer needs to have a thickness of 10 μm at minimum in order to secure abrasion resistance over time. In addition, when the release layer 734 exceeds 300 μm in thickness, the heat capacity of the fixing belt 730 increases, resulting in a longer warm-up time period. Further, additionally, a surface temperature of the fixing belt 730 is unlikely to decrease in the toner-fixing step, a cohesion effect of melted toner at an outlet of the fixing portion cannot be obtained, and thus the so-called hot offset occurs in which a releasing property of the fixing belt 730 is lowered, and toner particles of the toner image T is attached onto the fixing belt 730. Moreover, as a substrate of the fixing belt 730, the heat generating layer 732 formed of a metal may be used, or the resin layer having heat resistance, such as a fluorine-containing resin, a polyimide resin, a polyamide resin, a polyamide-imide resin, a PEEK resin, a PES resin, and a PPS resin, may be used.

The pressure roller 740 is constructed of a cylindrical metal core 741 made of a metal having a high thermal conductivity, for example, copper or aluminum, and an elastic member 742 having a high heat resistance and toner releasing property that is located on the surface of the metal core 741. The metal core 741 may be made of SUS other than the above-described metals. The pressure roller 740 presses the fixing roller 720 through the fixing belt 730 to form a nip portion N. According to this embodiment, the pressure roller 740 is arranged to engage into the fixing roller 720 (and the fixing belt 730) by causing the hardness of the pressure roller 740 to be higher than that of the fixing roller 720, whereby the recording medium 770 is in conformity with the circumferential shape of the pressure roller 740, thus to provide the effect that the recording medium 770 is likely to come off from the surface of the fixing belt 730. This pressure roller 740 is about 20 mm to about 40 mm in an external diameter, which is the same as the fixing roller 720. This pressure roller 740, however, is about 0.5 mm to about 2.0 mm in thickness, to be thinner than the fixing roller 720.

The induction heating unit 760 for heating the heating roller 710 by electromagnetic induction, as shown in FIG. 4, includes an exciting coil 761 serving as a field generation unit, and a coil guide plate 762 around which this exciting coil 761 is wound. The coil guide plate 762 has a semi-cylindrical shape that is located close to the perimeter surface of the heating roller 710. The exciting coil 761 is the one in which one long exciting coil wire is wound alternately in an axial direction of the heating roller 710 along this coil guide plate 762. Further, in the exciting coil 761, an oscillation circuit is connected to a driving power source (not shown) of variable frequencies. Outside of the exciting coil 761, an exciting coil core 763 of a semi-cylindrical shape that is made of a ferromagnetic material such as ferrites is fixed to an exciting coil core support 764 to be located in the proximity of the exciting coil 761.

<Cleaning Step>

The cleaning step is not particularly limited as long as toner remaining and adhering onto the surface of the electrophotographic photoconductor, from which the toner image has been transferred to the intermediate transfer medium using the primary transfer unit, are removed using the cleaning unit, and may be appropriately selected depending on the intended purpose.

The cleaning unit is not particularly limited as long as it can remove the toner remaining and adhering onto the surface of the electrophotographic photoconductor, and may be appropriately selected depending on the intended purpose. Examples thereof include a magnetic brush cleaner, an electrostatic brush cleaner, a magnetic roller cleaner, a blade cleaner, a brush cleaner, and a web cleaner.

Figure 6:
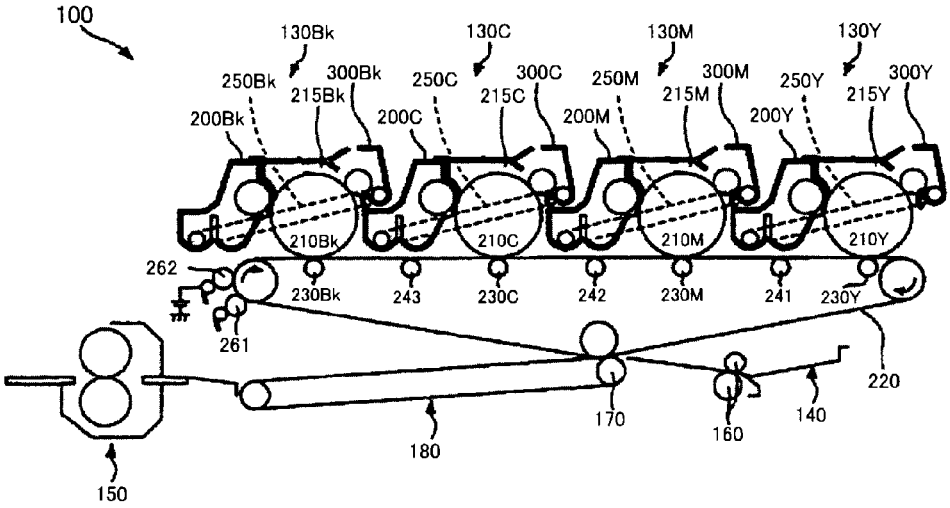
FIG. 6 is a schematic view of one exemplary image forming apparatus of the present invention.
Figure 7:
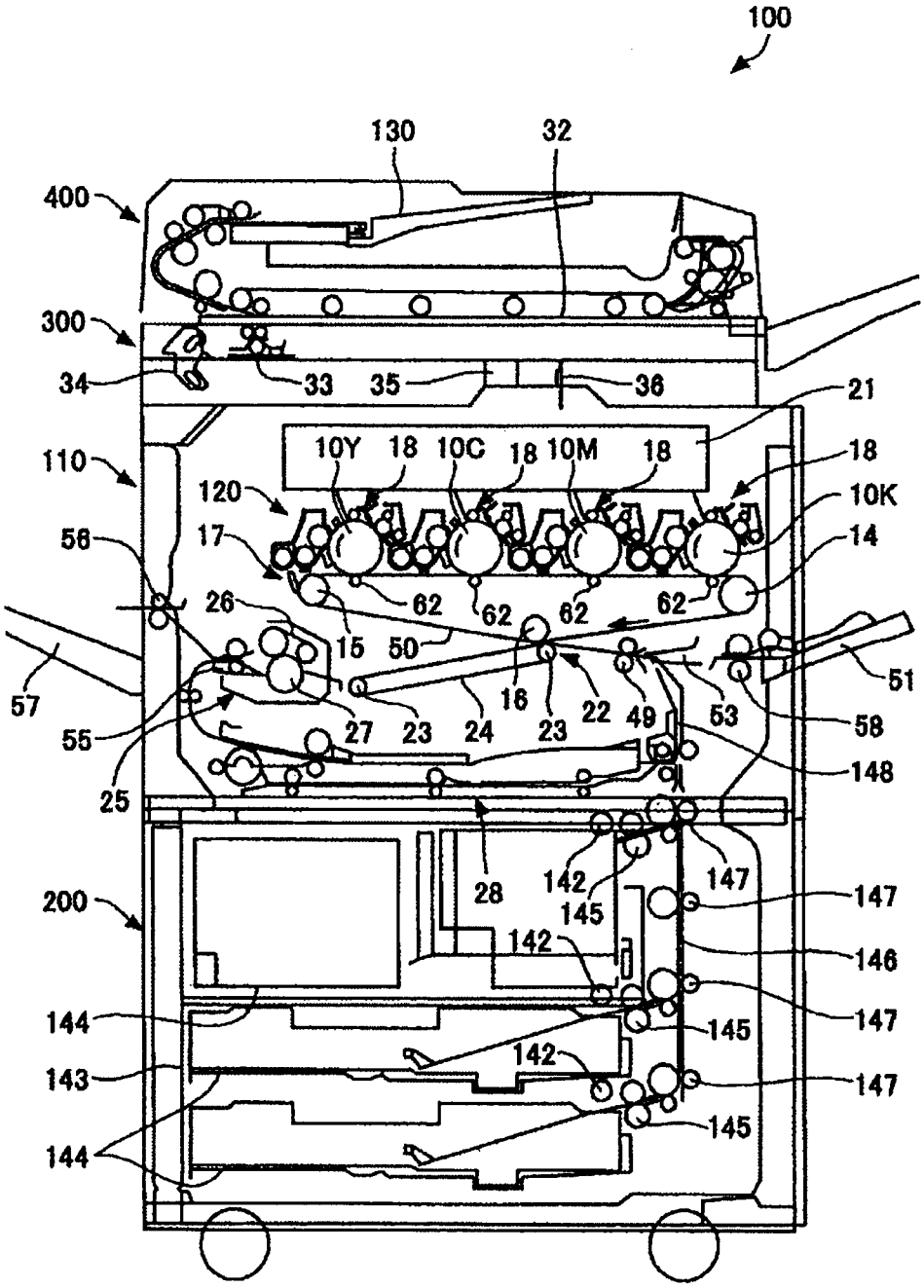
FIG. 7 is a schematic view of another exemplary image forming apparatus of the present invention.

As the full-color image forming apparatus used in the full-color image forming method, for example, a tandem-type image forming apparatus 100 shown in FIGS. 6 and 7 may be used. In FIG. 6, the image forming apparatus 100 mainly includes image writing units (not shown) for color image formation by an electrophotographic method, image forming units 130Bk, 130C, 130M and 130Y, and a paper feeder 140. According to image signals, image processing is performed in an image processing unit (not shown) for conversion to respective color signals of black (Bk), cyan (C), magenta (M), and yellow (Y) for image formation, and the color signals are sent to the image wiring units. The image writing units are a laser scanning optical system that includes, for example, a laser beam source, a deflector such as a rotary polygon meter, a scanning imaging optical system, and a group of mirrors (all not shown), has four writing optical paths corresponding to the color signals, and performs image writing according to the color signals in the image forming units 130Bk, 130C, 130M and 130Y.

The image forming units 130Bk, 130C, 130M and 130Y include photoconductors 210Bk, 210C, 210M and 210Y respectively for black, cyan, magenta, and yellow. An OPC photoconductor is generally used in the photoconductors 210Bk, 210C, 210M and 210Y for the respective colors. For example, chargers 215Bk, 215C, 215M and 215Y, the image writing units (exposing units) for emitting laser beams therefrom, developing devices 200Bk, 200C, 200M and 200Y for respective colors, primary transfer devices 230Bk, 230C, 230M and 230Y, cleaning devices 300Bk, 300C, 300M and 300Y, and charge-eliminating devices (not shown) are provided around the respective photoconductors 210Bk, 210C, 210M and 210Y. The developing devices 200Bk, 200C, 200M and 200Y use a two-component magnetic brush development system. Further, an intermediate transfer belt 220 is interposed between the photoconductors 210Bk, 210C, 210M and 210Y and the primary transfer devices 230Bk, 230C, 230M and 230Y. Color toner images are successively transferred from respective photoconductors onto the intermediate transfer belt 220 to form superimposed toner images that are supported by the intermediate transfer belt 220.

In some cases, a pre-transfer charger is preferably provided as a pre-transfer charging unit at a position that is outside the intermediate transfer belt 220 and after the passage of the final color through a primary transfer position and before a secondary transfer position. Before the toner images on the intermediate transfer belt 220, which have been transferred onto the photoconductors 210Bk, 210C, 210M and 210Y in the primary transfer unit, are transferred onto a transfer paper as a recording medium, the pre-transfer charger charges toner images uniformly to the same polarity.

The toner images on the intermediate transfer belt 220 transferred from the photoconductors 210Bk, 210C, 210M and 210Y include a halftone portion and a solid image portion or a portion in which the level of superimposition of toners is different. Accordingly, in some cases, the charge amount varies from a toner image to a toner image. Further, due to separation discharge generated in spaces on an adjacent downstream side of the primary transfer unit in the direction of movement of the intermediate transfer belt, a variation in charge amount within toner images on the intermediate transfer belt 220 after the primary transfer may occur. The variation in charge amount within the same toner image disadvantageously lowers a transfer latitude in the secondary transfer unit that transfers the toner images on the intermediate transfer belt 220 onto the transfer paper. Accordingly, the toner images before transfer onto the transfer paper are uniformly charged to the same polarity by the pre-transfer charger to eliminate the variation in charge amount within the same toner image and to improve the transfer latitude in the secondary transfer unit.

Thus, according to the image forming method wherein the toner images located on the intermediate transfer belt 220 and transferred from the photoconductors 210Bk, 210C, 210M and 210Y are evenly charged by the pre-transfer charger, even when a variation in charge amount of the toner images located on the intermediate transfer belt 220 exists, the transfer properties in the secondary transfer unit can be rendered almost constant over each portion of the toner images located on the intermediate transfer belt 220. Accordingly, a lowering in the transfer latitude in the transfer of the toner images onto the transfer paper can be suppressed, and the toner images can be stably transferred.

In the image forming method, the amount of charge by the pre-transfer charger varies depending upon the moving speed of the intermediate transfer belt 220 as the charging object. For example, when the moving speed of the intermediate transfer belt 220 is low, the period of time, for which the same part in the toner images on the intermediate transfer belt 220 passes through a region of charging by the pre-transfer charger, increased. Therefore, in this case, the charge amount is increased. On the other hand, when the moving speed of the intermediate transfer belt 220 is high, the charge amount of the toner images on the intermediate transfer belt 220 is decreased. Accordingly, when the moving speed of the intermediate transfer belt 220 changes during the passage of the toner images on the intermediate transfer belt 220 through the position of charging by the pre-transfer charger, preferably, the pre-transfer charger is regulated according to the moving speed of the intermediate transfer belt 220 so that the charge amount of the toner images does not change during the passage of the toner images on the intermediate transfer belt 220 through the position of charging by the pre-transfer charger.

Conductive rollers 241, 242 and 243 are provided between the primary transfer units 230Bk, 230C, 230M and 230Y. The transfer paper is fed from a paper feeder 140 and then is supported on a transfer belt 180 through a pair of registration rollers 160. At a portion where the intermediate transfer belt 220 comes into contact with the transfer belt 180, the toner images on the intermediate transfer belt 220 are transferred by a secondary transfer roller 170 onto the transfer paper to perform color image formation.

The transfer paper after image formation is transferred by a secondary transfer belt 180 to a fixing device 150 where the color image is fixed to provide a fixed color image. The toner remaining after transfer on the intermediate transfer belt 220 is removed form the belt by an intermediate transfer belt cleaning devices (conductive fur brushes) 261, 262.

The polarity of the toner on the intermediate transfer belt 220 before transfer onto the transfer paper has the same negative polarity as the polarity in the development. Accordingly, a positive transfer bias voltage is applied to a secondary transfer roller 170, and the toner is transferred onto the transfer paper. The nip pressure in this portion affects the transferability and significantly affects the fixability. The toner remaining after transfer and located on the intermediate transfer belt 220 is subjected to discharge electrification to positive polarity side; i.e., 0 to positive polarity, in a moment of the separation of the transfer paper from the intermediate transfer belt 220. Toner images formed on the transfer paper in jam or toner images in a non-image region of the transfer paper are not influenced by the secondary transfer and thus, of course, maintain negative polarity.

In one embodiment, the thickness of the photoconductor layer, the beam spot diameter of the optical system, and the quantity of light are 30 μm, 50 μm×60 μm, and 0.47 mW, respectively. The developing step is performed under such conditions that the charge (exposure side) potential V0 of the photoconductor (black) (210Bk) is −700 V, potential VL after exposure is −120 V, and the development bias voltage is −470 V, that is, the development potential is 350 V. The visible image of the toner (black) formed on the photoconductor (black) (210Bk) is then subjected to transfer (intermediate transfer belt and transfer paper) and the fixing step and consequently is completed as an image. Regarding the transfer, all the colors are first transferred from the primary transfer devices 230Bk, 230C, 230M and 230Y to the intermediate transfer belt 220 followed by transfer to the transfer paper by applying bias to a separate secondary transfer roller 170.

Next, the photoconductor cleaning device will be described in detail. In FIG. 6, the developing devices 200Bk, 200C, 200M and 200Y are connected to respective cleaning devices 300Bk, 300C, 300M and 300Y through toner transfer tubes 250Bk, 250C, 250M and 250Y (dashed lines in FIG. 6). A screw (not shown) is provided within the toner transfer tubes 250Bk, 250C, 250M and 250Y, and the toners recovered in the cleaning devices 300Bk, 300C, 300M and 300Y are transferred to the respective developing devices 200Bk, 200C, 200M and 200Y.

A conventionally used direct transfer system including a combination of four photoconductor drums with belt transfer has the following drawback. Specifically, upon abutting of the photoconductor against the transfer paper, paper dust is adhered onto the photoconductor. Therefore, the toner recovered from the photoconductor contains paper dust and thus cannot be used because, in the image formation, an image deterioration such as toner dropouts occurs. Further, in a conventionally used system including a combination of one photoconductor drum with intermediate transfer, the adoption of the intermediate transfer medium has eliminated a problem of the adherence of paper dust onto the photoconductor during the transfer onto the transfer paper. In this system, however, when recycling of the residual toner on the photoconductor is contemplated, the separation of the mixed color toners is practically impossible. The use of the mixed color toners as a black toner has been proposed. However, even when all the colors are mixed, a black color is not produced. Further, colors vary depending upon printing modes. Accordingly, in the one-photoconductor construction, recycling of the toner is impossible.

By contrast, in the full-color image forming apparatus, since the intermediate transfer belt 220 is used, the contamination with paper dust is not significant. Further, the adherence of paper dust onto the intermediate transfer belt 220 during the transfer onto the paper can also be prevented. Since each of the photoconductors 210Bk, 210C, 210M and 210Y uses independent respective color toners, there is no need to perform contacting and separating of the photoconductor cleaning devices 300Bk, 300C, 300M and 300Y Accordingly, only the toner can be reliably recovered.

The positively charged toner remaining after transfer on the intermediate transfer belt 220 is removed by cleaning with a conductive fur brush 262 to which a negative voltage has been applied. A voltage can be applied to the conductive fur brush 262 in the same manner as in the application of the voltage to a conductive fur brush 261, except that the polarity is different. The toner remaining after transfer can be almost completely removed by cleaning with the two conductive fur brushes 261 and 262. The toner, paper dust, talc and the like, remaining unremoved by cleaning with the conductive fur brush 262 are negatively charged by a negative voltage of the conductive fur brush 262. The subsequent primary transfer of black is transfer by a positive voltage. Accordingly, the negatively charged toner and the like are attracted toward the intermediate transfer belt 220, and, thus, the transfer to the photoconductor (black) (210Bk) side can be prevented.

Next, the intermediate transfer belt 220 used in the image forming apparatus will be described. As described above, the intermediate transfer belt is preferably a resin layer having a single layer structure. If necessary, the intermediate transfer belt may have an elastic layer and a surface layer.

Examples the resin materials constituting the resin layer include, but not limited to, polycarbonate resins, fluorine resins (such as ETFE and PVDF); polystyrenes, chloropolystyrenes, poly-α-methylstyrenes; styrene resins (homopolymers or copolymers containing styrene or styrene substituents) such as styrene-butadiene copolymers, styrene-vinyl chloride copolymers, styrene-vinyl acetate copolymers, styrene-maleic acid copolymers, styrene-acrylate copolymers (such as styrene-methyl acrylate copolymers, styrene-ethyl acrylate copolymers, styrene-butyl acrylate copolymers, styrene-octyl acrylate copolymers, and styrene-phenyl acrylate copolymers), styrene-methacrylate copolymers (such as styrene-methyl methacrylate copolymers, styrene-ethyl methacrylate copolymers and styrene-phenyl methacrylate copolymers); styrene-α-chloromethyl acrylate copolymers, styrene-acrylonitrile acrylate copolymers, methyl methacrylate resins, and butyl methacrylate resins; ethyl acrylate resins, butyl acrylate resins, modified acrylic resins (such as silicone-modified acrylic resins, vinyl chloride resin-modified acrylic resins and acrylic urethane resins); vinyl chloride resins, styrene-vinyl acetate copolymers, vinyl chloride-vinyl acetate copolymers, rosin-modified maleic acid resins, phenol resins, epoxy resins, polyester resins, polyester polyurethane resins, polyethylene resins, polypropylene resins, polybutadiene resins, polyvinylidene chloride resins, ionomer resins, polyurethane resins, silicone resins, ketone resins, ethylene-ethylacrylate copolymers, xylene resins, polyvinylbutylal resins, polyamide resins and modified polyphenylene oxide resins. These resins may be used alone or in combination.

Examples of elastic materials (elastic rubbers, elastomers) constituting the elastic layer include, but not limited to, butyl rubber, fluorine-based rubber, acryl rubber, EPDM rubber, NBR rubber, acrylonitrile-butadiene-styrene natural rubber, isoprene rubber, styrene-butadiene rubber, butadiene rubber, ethylene-propylene rubber, ethylene-propylene terpolymers, chloroprene rubber, chlorosulfonated polyethylene, chlorinated polyethylene, urethane rubber, syndiotactic 1,2-polybutadiene, epichlorohydrin-based rubber, silicone rubber, fluorine rubber, polysulfide rubber, polynorbornene rubber, hydrogenated nitrile rubber, and thermoplastic elastomers (for example, polystyrene, polyolefin, polyvinyl chloride, polyurethane, polyamide, polyurea, polyester and fluorine resins). These rubbers may be used alone or in combination.

The material used for the surface layer is not particularly limited but is required to reduce toner adhesion force to the surface of the intermediate transfer belt so as to improve the secondary transfer property. The surface layer preferably contains one or two or more of polyurethane resin, polyester resin, and epoxy resin, and one or two or more of materials that reduce surface energy and enhance lubrication, for example, powders or particles such as fluorine resin, fluorine compound, carbon fluoride, titanium dioxide, and silicon carbide, or a dispersion of the materials having different particle diameters. In addition, it is possible to use a material such as fluorine rubber that is treated with heat so that a fluorine-rich layer is formed on the surface and the surface energy is reduced.

The resin layer and elastic layer preferably contain a conductive agent for adjusting resistance. The conductive agent for adjusting resistance is not particularly limited and may be appropriately selected depending on the intended purpose. Examples thereof include, but not limited to, carbon black, graphite, metal powders such as aluminum and nickel; conductive metal oxides such as tin oxide, titanium oxide, antimony oxide, indium oxide, potassium titanate, antimony tin oxide (ATO), and indium tin oxide (ITO). The conductive metal oxides may be coated with insulating fine particles such as barium sulfate, magnesium silicate, and calcium carbonate.

FIG. 7 shows another example of the image forming apparatus used in the image forming method of the present invention and is a copier 100 equipped with an electrophotographic image forming apparatus of a tandem indirect transfer system. In FIG. 7, the copier 100 includes a copier main body 110, a paper feed table 200 for mounting the copier main body 110, a scanner 300, which is arranged over the copier main body 110, and an automatic document feeder (ADF) 400, which is arranged over the scanner 300. The copier main body 110 has an endless belt intermediate transfer medium 50 in the center.

The intermediate transfer medium is stretched around three support rollers 14, 15, and 16 and rotates clockwise as shown in FIG. 7. An intermediate transfer medium cleaning device 17 for removing residual toner on the intermediate transfer medium 50 after image transfer is provided near the second support roller 15 of the three support rollers. A tandem image forming device 120 has four image forming units 18 for yellow, cyan, magenta, and black, which face the intermediate transfer medium 50 stretched around the first support roller 14 and the second support roller 15, and are arranged side by side in the transfer rotation direction thereof.

An exposing device 21 is provided over the tandem image forming device 120 as shown in FIG. 7. A secondary transfer device 22 is provided in the side opposite to the side where the tandem image forming device 120 is provided, via the intermediate transfer medium 50. The secondary transfer device 22 has an endless second transfer belt 24 stretched around a pair of rollers 23, and is arranged so as to press against the third support roller 16 via the intermediate transfer medium 50, thereby transferring an image carried on the intermediate transfer medium 50 onto a sheet. A fixing device 25 configured to fix the transferred image on the sheet is provided near the secondary transfer device 22. The fixing device 25 has an endless fixing belt 26 and a pressure roller 27 pressed against the fixing belt 26. The secondary transfer device 22 includes a sheet conveyance function in which the sheet on which the image has been transferred is conveyed to the fixing device 25. As the secondary transfer device 22, a transfer roller or a non-contact charger may be provided, however, these are difficult to provide in conjunction with the sheet conveyance function. A sheet inversion device 28 for forming images on both sides of a sheet is provided parallel to the tandem image forming device 120 and under the secondary transfer device 22 and fixing device 25.

At first, a document is placed on a document table 130 of the automatic document feeder 400, when a copy is made using the color electrophotographic apparatus. Alternatively, the automatic document feeder 400 is opened, the document is placed onto a contact glass 32 of the scanner 300, and the automatic document feeder 400 is closed.

When a start switch (not shown) is pressed, a document placed on the automatic document feeder 400 is conveyed onto the contact glass 32. When the document is initially placed on the contact glass 32, the scanner 300 is immediately driven to operate a first carriage 33 and a second carriage 34. At the first carriage 33, light is applied from a light source to the document, and reflected light from the document is further reflected toward the second carriage 34. The reflected light is further reflected by a mirror of the second carriage 34 and passes through image-forming lens 35 into a read sensor 36 to thereby read the document.

When the start switch (not shown) is pressed, one of the support rollers 14, 15 and 16 is rotated by a drive motor (not shown), and as a result, the other two support rollers are rotated by the rotation of the driven support roller. In this way, the intermediate transfer medium 50 runs around the support rollers 14, 15 and 16. Simultaneously, the individual image forming units 18 respectively rotate their photoconductors 10K, 10Y, 10M and 10C to thereby form black, yellow, magenta, and cyan monochrome images on the photoconductors 10K, 10Y, 10M and 10C, respectively. With the conveyance of the intermediate transfer medium 50 located between the photoconductors 10K, 10Y, 10M and 10C and the primary transfer devices 62, the monochrome images are sequentially transferred to form a composite color image on the intermediate transfer medium 50.

Separately, when the start switch (not shown) is pressed, one of feeder rollers 142 of the paper feed table 200 is selectively rotated, sheets are ejected from one of multiple feeder cassettes 144 in a paper bank 143 and are separated in a separation roller 145 one by one into a feeder path 146, are conveyed by a conveyance roller 147 into a feeder path 148 in the copier main body 100 and are bumped against registration rollers 49.

Alternatively, pressing the start switch rotates the feeder roller to eject sheets on a manual bypass tray 51, and the sheets are separated one by one on a separation roller 58 into a manual bypass feeder path 53 and are bumped against the registration rollers 49.

The registration rollers 49 are rotated synchronously with the movement of the composite color image on the intermediate transfer medium 50 to convey the sheet into between the intermediate transfer medium 50 and the secondary transfer device 22, and the composite color image is transferred onto the sheet by action of the secondary transfer device 22 to thereby form a color image.

The sheet on which the image has been transferred is conveyed by the secondary transfer device 22 into the fixing device 25, and heat and pressure are applied to the sheet in the fixing device 25 to fix the transferred image, changes its direction by action of a switch claw 55, and is ejected by an ejecting roller 56 to be stacked on an output tray 57. Alternatively, the moving direction of the paper is changed by the switching claw 55, and the paper is conveyed to the sheet inversion device 28 where it is inverted, and guided again to the transfer position in order that an image is formed also on the back surface thereof, then the paper is ejected by the ejecting roller 56 and stacked on the output tray 57.

On the other hand, in the intermediate transfer medium 50 after the image transfer, the toner, which remains on the intermediate transfer medium 50 after the image transfer, is removed by the intermediate transfer medium cleaning device 17, and the intermediate transfer medium 50 again gets ready for image formation by the tandem image forming device 120. The registration rollers 49 are generally used in a grounded state. Bias may also be applied to the registration rollers 49 to remove paper dust of the sheet.

(Process Cartridge)

A process cartridge used in the present invention is adapted for use in an image forming apparatus, the process cartridge including: an electrophotographic photoconductor; and a developing unit, wherein the electrophotographic photoconductor and the developing unit are integrally supported, and the process cartridge is detachably attached to a main body of the image forming apparatus, wherein the image forming apparatus contains: the electrophotographic photoconductor; a charging unit configured to charge the electrophotographic photoconductor; an exposing unit configured to expose the charged electrophotographic photoconductor to light so as to form a latent electrostatic image thereon; the developing unit configured to develop the latent electrostatic image formed on the electrophotographic photoconductor with the toner, so as to form a toner image; a transfer unit configured to transfer the toner image formed on the electrophotographic photoconductor, via an intermediate transfer medium or directly, to a recording medium; a fixing unit configured to fix the toner image on the recording medium by means of a heat and pressure-applying member; and a cleaning unit configured to clean the toner remaining and adhering onto a surface of the electrophotographic photoconductor, from which the toner image has been transferred to the intermediate transfer medium or the recording medium using the transfer unit. The developing unit includes a toner produced by the above-described method for producing a toner of the present invention. The developing device and the charging device described above are suitable for use as the developing unit and the charging unit, respectively.

Figure 8:
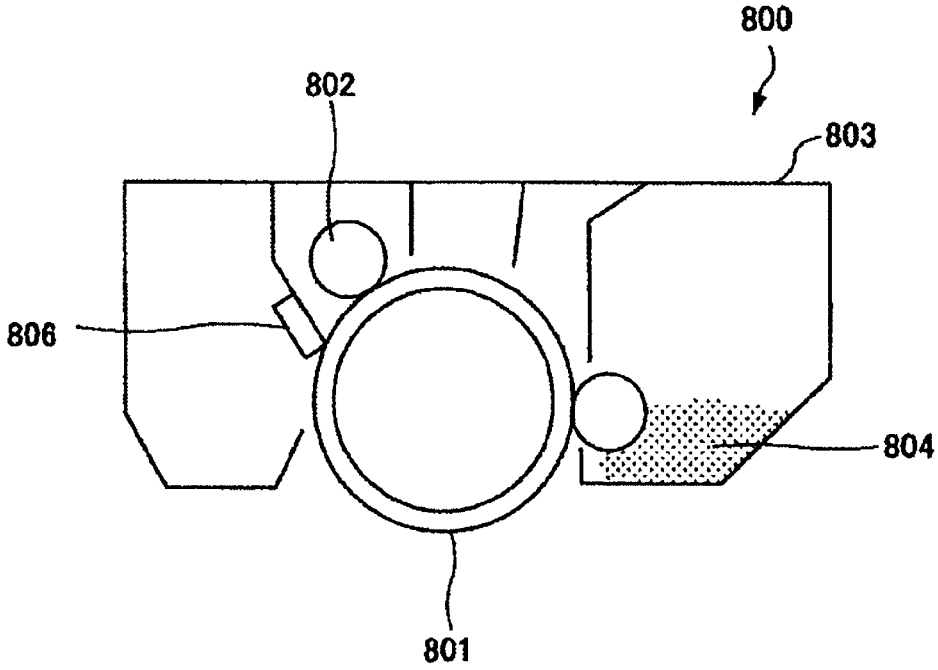
FIG. 8 is a schematic view of one exemplary process cartridge of the present invention.

An example of the process cartridge is shown in FIG. 8. A process cartridge 800 shown in FIG. 8 includes a photoconductor 801, a charging unit 802, a developing unit 803, and a cleaning unit 806. In the operation of this process cartridge 800, the photoconductor 801 is rotated at a specific peripheral speed. In the course of rotating, the photoconductor 801 receives from the charging unit 802 a uniform, positive or negative electrical charge of a specific potential around its periphery, and then receives image exposure light from an image exposing unit (not shown), such as slit exposure or laser beam scanning exposure, and in this way a latent electrostatic image is formed on the periphery of the photoconductor 801. The latent electrostatic image thus formed is then developed with a toner 804 by a developing unit 803 containing the toner 804, and the developed toner image is transferred by a transfer unit (not shown) onto a recording medium that is fed from a paper feeder to in between the photoconductor 801 and the transfer unit, in synchronization with the rotation of the photoconductor 801. The recording medium on which the image has been transferred is separated from the surface of the photoconductor 801, introduced into an image fixing unit (not shown) so as to fix the image thereon, and this product is printed out from the device as a copy or a print. The surface of the photoconductor 801 after the image transfer is cleaned by the cleaning unit 806 so as to remove the residual toner after the transfer, and is electrically neutralized and repeatedly used for image formation.

EXAMPLE

The present invention will be described in more detail with reference to the following Examples and Comparative Examples. However, it should be noted that the present invention is not limited to these Examples and Comparative Examples.

At first, measurement method will be described.

(Measurement Method of Particle Diameter of Dispersoid and Dispersed Particle Size Distribution of Toner Material Liquid)

In the present invention, the particle diameter of a dispersoid and dispersed particle size distribution of a toner material liquid were measured using MICROTRACK UPA 150 (manufactured by Nikkiso Co., Ltd.) and analyzed using Analysis software (MICROTRACK Particle Size Analyzer Ver. 10.1.2-016EE, manufactured by Nikkiso Co., Ltd.). Specifically, the toner material liquid was set in a sample glass vessel (30 mL) and then the solvent for use in preparing the toner material liquid is added thereto to prepare a 10% by mass of a dispersion liquid. The dispersion liquid was subject to dispersion treatment for 2 minutes by using an ultrasonic dispersion device (W-113MK-II, manufactured by Honda Electronics Co., Ltd.). After measuring the background using the solvent for use in the toner material liquid to be measured, the dispersion liquid was dropped in the device and the dispersed particle diameter was measured under the condition that the value of sample loading of the measuring device ranged from 1 to 10. In this method, it was important that measurement was performed under the condition as described above in terms of the measuring reproducibility of the dispersed particle diameter. The dropping amount of the dispersion liquid was adjusted to obtain the above described values of the sample loading.

Measurement and analysis conditions ware set as follows.

Distribution display: volume

Selection of particle size division: standard

Number of channels: 44

Measurement time: 60 seconds

Number of measurement: 1

Transmission property of particle: transmission

Fraction index of particle: 1.5

Particle shape: non-spherical

Density: 1 g/cm$^3$

Value of the solvent fraction index: value for the solvent for use in the toner material liquid listed in "Guideline relating to the input conditions for measurement" issued by Nikkiso Co., Ltd.

(BET Specific Surface Area of Toner)

The BET specific surface area of a toner was measured with an automatic specific surface area/pore distribution measuring device TRISTAR 3000 (manufactured by SHIMADZU CORPORATION). One gram of the toner was placed in a dedicated cell, and the inside of the dedicated cell was degassed using a degassing dedicated unit for TRISTAR, VACUPREP 061 (manufactured by SHIMADZU CORPORATION). The degassing treatment was carried out at room temperature at least for 20 hr under the condition of reduced pressure at equal to or less than 100 mtorr. The dedicated cell which had been subjected to the degassing treatment could be automatically subjected to the BET specific surface area measurement with TRISTAR 3000. Nitrogen gas was used as adsorption gas.

(Electric Conductivity of Aqueous Dispersion)

The electric conductivity of an aqueous dispersion containing toner particles was measured using an electric conductivity measurement device CT-57101B (manufactured by DKK-TOA CORPORATION). The electric conductivity of the aqueous dispersion was automatically obtained by inserting a dedicated cell into the aqueous dispersion containing the toner particles at room atmosphere.

(Concentration of Ionic Material)

The concentration of an ionic material was measured by HPLC. Specifically, the concentration of the ionic material was measured in the following manner.

As a column, Shodex Asahipak GF-310 was used, as a mobile phase, a mixture of an aqueous sodium sulfate solution and acetonitrile was used, and a UV-Vis detector was used for detection. A sample solution was diluted ten times with water, and filtrated through a membrane filter having 0.45 μm-pores. The filtrated sample solution (10 μL) was charged in the column. The anionic surfactant was adjusted with water to be 10 mg/L, 50 mg/L, 100 mg/L, followed by analysis, and a calibration curve was formed from values of areas of the anionic surfactants in the respective concentrations. The separation conditions were as follows.

Column: Shodex Asahipak GF-310HQ (300 mL×7.5 mm I.D.)

Shodex Asahipak GF-310HQ (50 mL×7.5 mm I.D.)

Mobile phase: 50 mmol/L aqueous sodium sulfate solution/acetonitrile=1/1 (mass ratio)

Flow rate: 0.6 mL/min

Temperature: 50° C.

Charge amount: 10 μL

Detection: UV-VIS detector

Wavelength: 240 nm

Lamp: D2

Response: 1.0 s (Charge Amount of Toner Base Particles)

The charge amount of toner base particles was measured with a V blow-off device (manufactured by RICOH SOZO KAIHATSU K.K.). A mixture of the toner base particles and a carrier as a developer having a toner concentration of 7% by mass was allowed to stand at a predetermined environment (temperature, humidity) for 2 hr. The developer was then placed in a metallic gauge, followed by mixing with stirring in a stirring device at 280 rpm for 600 sec. One gram of the developer was weighed from 6 g of the initial developer, and the charge amount distribution of the toner base particles was measured by a single mode method with the V blow-off device (manufactured by RICOH SOZO KAIHATSU K.K.). At the time of blow, an opening of 635 mesh was used. In the single mode method of the V blow-off device (manufactured by RICOH SOZO KAIHATSU K.K.), a single mode was selected according to the instruction manual, and measurement was performed under conditions of height 5 mm, suction 100, and blow twice.

A production example of the toner used for evaluation will be specifically described. However, the toner used in the present invention will not be limited to these examples.

Production Example 1

<Preparation of Solution and/or Dispersion Liquid (Organic Solvent Solution) of Toner Material>

—Synthesis of Unmodified Polyester Resin (Low-Molecular-Weight Polyester Resin)—

Into a reaction vessel equipped with a condenser, a stirrer, and a nitrogen-introducing tube, 67 parts by mass of bisphenol A ethylene oxide (2 mol) adduct, 84 parts by mass of bisphenol A propionoxide (3 mol) adduct, 274 parts by mass of terephthalic acid, and 2 parts by mass of dibutyltin oxide were charged, allowing the resultant mixture to react for 8 hours at 230° C. under normal pressure, so as to obtain a reaction liquid. Subsequently, the reaction liquid was allowed to react for 5 hours under reduced pressure of 10 mmHg to 15 mmHg, to thereby synthesize unmodified polyester resin.

The thus-obtained unmodified polyester resin had a number average molecular weight (Mn) of 2,100, a weight average molecular weight (Mw) of 5,600, and a glass transition temperature, Tg, of 50° C.

—Preparation of Masterbatch (MB)—

Water (1,000 parts by mass), 540 parts by mass of carbon black ("Printex 35" manufactured by Degussa, DBP oil absorption amount: 42 mL/100 g, pH 9.5), and 1,200 parts by mass of the unmodified polyester resin were mixed using HENSCHEL MIXER (manufactured by NIPPON COKE & ENGINEERING CO., LTD.), to obtain a mixture. The resultant mixture was kneaded at 150° C. for 30 minutes with a two-roller mill, and thereafter rolled and cooled, and milled with a pulverizer (manufactured by Hosokawa Micron Corporation), to thereby prepare masterbatch.

—Synthesis of Prepolymer—

Into a reaction vessel equipped with a condenser, a stirrer, and a nitrogen-introducing tube, 682 parts by mass of bisphenol A ethylene oxide (2 mol) adduct, 81 parts by mass of bisphenol A propylene oxide (2 mol) adduct, 283 parts by mass of terephthalic acid, 22 parts by mass of trimellitic anhydride, and 2 parts by mass of dibutyltin oxide were charged, allowing the resultant mixture to react for 8 hours at 230° C. under normal pressure. Subsequently, the reaction mixture was allowed to react for 5 hours under reduced pressure of 10 mmHg to 15 mmHg, to thereby synthesize an intermediate polyester.

The thus-obtained intermediate polyester had a number average molecular weight (Mn) of 2,100, a weight average molecular weight (Mw) of 9,600, a glass transition temperature, Tg, of 55° C., an acid value of 0.5 mgKOH/g, and a hydroxyl group value of 49 mgKOH/g.

Subsequently, into a reaction vessel equipped with a condenser, a stirrer, and a nitrogen-introducing tube, 411 parts by mass of the intermediate polyester, 89 parts by mass of isophorone diisocyanate, and 500 parts by mass of ethyl acetate were charged, allowing the resultant mixture to react for 5 hours at 100° C. to thereby synthesize a prepolymer, i.e., a polymer reactive with an active hydrogen group-containing compound. The prepolymer thus obtained had a free isocyanate content of 1.60% by mass and solid content concentration of 50% by mass (150° C., after being left for 45 minutes).

—Preparation of Toner Material Phase—

The unmodified polyester resin (100 parts by mass) and 130 parts by mass of ethyl acetate were charged in a beaker, followed by dissolving the unmodified polyester resin in the ethyl acetate with stirring. Then, 10 parts by mass of carnauba wax (molecular weight=1,800, acid value=2.5, penetration=1.5 mm (40° C.)), and 10 parts by mass of the masterbatch were charged into the beaker. The resultant mixture was treated with a bead mill ("ULTRA VISCOMILL," manufactured by AIMEX CO., Ltd.) under the following conditions: a liquid feed rate of 1 kg/r, disc circumferential velocity of 6 m/s, 0.5 mm zirconia beads packed to 80% by volume, and 3 passes, to thereby produce a starting material solution. Further, 40 parts by mass of the prepolymer was added thereto, followed by stirring, to thereby a solution and/or dispersion liquid (organic solvent solution) of the toner material.

Production Example 2

<Synthesis of Ketimine (Active Hydrogen Group-Containing Compound)>

In a reaction vessel equipped with a stirring rod and a thermometer, 170 parts by mass of isophorone diamine and 75 parts by mass of methyl ethyl ketone were charged, and reacted at 50° C. for 5 hours to synthesize a ketimine compound (active hydrogen group-containing compound). The obtained ketimine compound (active hydrogen group-containing compound) had an amine value of 418 mgKOH/g.

Production Example 3

<Preparation of Fine Resin Particles>

Into a reaction vessel equipped with a stirring rod and a thermometer, 683 parts by mass of water, 16 parts by mass of sodium salt of sulfuric acid ester of ethylene oxide adduct of methacrylic acid, Eleminol RS-30 (manufactured by Sanyo Chemical Industries Ltd.), 83 parts by mass of styrene, 83 parts by mass of methacrylic acid, 110 parts by mass of butyl acrylate, and 1 part by mass of ammonium persulfate were charged, and then stirred at 400 rpm for 15 minutes to thereby obtain a white emulsion. The emulsion was heated to a system temperature of 75° C. and was allowed to react for 5 hours. Then, 30 parts by mass of a 1% by mass aqueous ammonium persulfate solution was added to the reaction mixture, followed by aging at 75° C. for 5 hours, to thereby obtain an aqueous dispersion liquid of a vinyl resin (a copolymer of styrene-methacrylic acid-butyl acrylate-sodium salt of sulfate ester of methacrylic acid-ethylene oxide adduct), i.e. fine resin particle dispersion liquid. The volume average particle diameter of the fine resin particle dispersion liquid was found to be 42 nm, when measured using LA-920 (manufactured by Horiba, Ltd.).

Example 1

<Production of Toner a>

—Preparation of Aqueous Medium $I_0$—

Water (660 parts by mass), 25 parts by mass of the fine resin particle dispersion liquid, 25 parts by mass of 48.5% by mass aqueous solution of sodium dodecyldiphenyl ether disulfonate "ELEMINOL MON-7" (manufactured by Sanyo Chemical Industries Ltd.) and 60 parts by mass of ethyl acetate were mixed and stirred to obtain an opaque white liquid (aqueous phase).

—Preparation of Emulsion and/or Dispersion Liquid—

The aqueous medium $I_0$ phase (150 parts by mass) was placed in a container, and then stirred at 12,000 rpm with a TK homomixer (manufactured by Tokushu Kika Kogyo Co., Ltd.). Subsequently, 100 parts by mass of the solution and/or dispersion liquid (organic solvent solution) of the toner material and 0.35 parts by mass of the ketimine compound were added to the thus-treated aqueous medium $I_0$ phase, and the resultant mixture was mixed for 10 min to thereby prepare emulsion and/or dispersion liquid (emulsified slurry).

—Removal of Organic Solvent—

A flask equipped with a degassing tube, a stirrer, and a thermometer was charged with 100 parts by mass of the emulsified slurry. The solvent was removed by stirring the emulsified slurry at a circumferential velocity of 20 m/min at 30° C. for 12 hours under reduced pressure to give a desolvated slurry.

—Washing (Aqueous Dispersion Production Step)—

The whole amount of the desolvated slurry was filtrated under reduced pressure. Then, 300 parts by mass of ion-exchanged water as the aqueous medium I was added to the filter cake, followed by mixing and redispersing with a TK homomixer (at a rotation speed of 12,000 rpm for 10 min) and filtrating. Further, 300 parts by mass of ion-exchanged water was added to the filter cake, followed by mixing with a TK homomixer (at a rotation speed of 12,000 rpm for 10 min) and filtrating. This procedure was performed three times. When the electric conductivity of the redispersed aqueous dispersion became 10 μS/cm or lower, washing was terminated to obtain a washed slurry (aqueous dispersion). The electric conductivity of the resultant aqueous dispersion was 7 μS/cm.

—Heat Treatment (Heat Treatment Step)—

A flask equipped with a stirrer and a thermometer was charged with the resultant washed slurry (aqueous dispersion), and the resultant washed slurry was subjected to heat treatment with stirring at a circumferential velocity of 20 m/min at 50° C. for 60 minutes, and then filtrated, to thereby obtain a filter cake. The electric conductivity of the aqueous dispersion which had been subjected to heat treatment was 26 μS/cm.

—Drying—

The thus obtained filter cake was dried with a circular wind dryer at 45° C. for 48 hr. The dried product was sieved through a sieve with 75 μm-mesh opening, to thereby obtain toner base particles. The toner base particles had a glass transition temperature, Tg, of 48° C. Toner Base Particles used in Examples below also had the glass transition temperature, Tg, of 48° C.

—External Addition Treatment—

The toner base particles (100 parts by mass) were mixed with 0.6 parts by mass of hydrophobic silica having an average particle diameter of 100 nm, 1.0 part by mass of titanium oxide having an average particle diameter of 20 nm, and 0.8 parts by mass of a fine powder of hydrophobic silica having an average particle diameter of 15 nm using a HENSCHEL MIXER to obtain Toner a.

Example 2

<Production of Toner b>

Toner b was produced in the same manner as in Example 1, except that the heat treatment temperature in the heat treatment step was changed to 55° C. The electric conductivity of an aqueous dispersion which had been subjected to heat treatment was 40 μS/cm. The charge amount of the base particles decreased by 3 μC/g, but sufficient charging ability was obtained.

Example 3

<Production of Toner c>

Toner c was produced in the same manner as in Example 1, except that the heat treatment temperature in the heat treatment step was changed to 45° C. The electric conductivity of an aqueous dispersion which had been subjected to heat treatment was 15 μS/cm. The charge amount of the base particles decreased by 1 μC/g, but sufficient charging ability was obtained.

Example 4

<Production of Toner d>

Toner d was produced in the same manner as in Example 1, except that the heat treatment time in the heat treatment step was changed to 180 minutes. The electric conductivity of an aqueous dispersion which had been subjected to heat treatment was 46 μS/cm. The charge amount of the base particles decreased by 4 μC/g, but sufficient charging ability was obtained.

Example 5

<Production of Toner e>

Toner e was produced in the same manner as in Example 1, except that the heat treatment time in the heat treatment step was changed to 10 minutes. The electric conductivity of an aqueous dispersion which had been subjected to heat treatment was 13 μS/cm. The charge amount of the base particles decreased by 1 μC/g, but sufficient charging ability was obtained.

Example 6

<Production of Toner f>

Toner f was produced in the same manner as in Example 1, except that the heat treatment temperature in the heat treatment step was changed to 58° C. The electric conductivity of an aqueous dispersion which had been subjected to heat treatment was 56 μS/cm. The charge amount of the base particles decreased by 5 μC/g, but sufficient charging ability was obtained.

Example 7

<Production of Toner g>

Toner g was produced in the same manner as in Example 1, except that the heat treatment temperature in the heat treatment step was changed to 38° C. The electric conductivity of an aqueous dispersion which had been subjected to heat treatment was 12 μS/cm. The charge amount of the base particles did not decrease, and sufficient charging ability was obtained.

Comparative Example 1

<Production of Toner h>

Toner h was produced in the same manner as in Example 1, except that the heat treatment temperature in the heat treatment step was changed to 65° C. The electric conductivity of an aqueous dispersion which had been subjected to heat treatment was 72 μS/cm. The charge amount of the base particles decreased by 8 μC/g. The base particles were severely cohered to each other, and there was no improvement in particle formation.

Comparative Example 2

<Production of Toner i>

Toner i was produced in the same manner as in Example 1, except that the heat treatment time in the heat treatment step was changed to 600 minutes. The electric conductivity of an aqueous dispersion which had been subjected to heat treatment was 74 μS/cm. The charge amount of the base particles decreased by 10 μC/g. It was difficult to obtain suitable charging ability.

The physical properties of toners of the aqueous dispersions obtained in Examples 1 to 7 and Comparative Examples 1 to 2 are shown in Table 1.

TABLE 1

| | Heating conditions | Electric conductivity after heat treatment | Increased value of electric conductivity | Increased value of concentration of ionic material | Charge amount of base particles |
|---|---|---|---|---|---|
| Ex. 1 | 50° C./60 min | 26 μS/cm | 19 μS/cm | 14 ppm | 38 μS/g |
| Ex. 2 | 55° C./60 min | 40 μS/cm | 33 μS/cm | 28 ppm | 37 μS/g |
| Ex. 3 | 45° C./60 min | 15 μS/cm | 8 μS/cm | 8 ppm | 39 μS/g |
| Ex. 4 | 50° C./180 min | 46 μS/cm | 39 μS/cm | 30 ppm | 36 μS/g |
| Ex. 5 | 50° C./10 min | 13 μS/cm | 6 μS/cm | 0 ppm | 39 μS/g |
| Ex. 6 | 58° C./60 min | 56 μS/cm | 49 μS/cm | 36 ppm | 35 μS/g |

TABLE 1-continued

| | Heating conditions | Electric conductivity after heat treatment | Increased value of electric conductivity | Increased value of concentration of ionic material | Charge amount of base particles |
|---|---|---|---|---|---|
| Ex. 7 | 38° C./60 min | 12 μS/cm | 5 μS/cm | 5 ppm | 40 μS/g |
| Comp. Ex. 1 | 65° C./60 min | 72 μS/cm | 65 μS/cm | 41 ppm | 32 μS/g |
| Comp. Ex. 2 | 50° C./600 min | 74 μS/cm | 67 μS/cm | 44 ppm | 30 μS/g |

<Production of Carrier>

Next, description will be given to the production example of a carrier used for the evaluation of each toner in an image forming apparatus. The carrier used in the present invention is not limited these Examples.

| -Carrier- | |
|---|---|
| Acrylic resin solution (solid content: 50% by mass) | 21.0 parts by mass |
| Guanamine solution (solid content: 70% by mass) | 6.4 parts by mass |
| Alumina particles (0.3 μm, specific resistance: $10^{14}$ Ω · cm) | 7.6 parts by mass |
| Silicone resin solution (SR2410, solid content: 23% by mass, manufactured by Dow Corning Toray Silicone Co., Ltd.) | 65.0 parts by mass |
| Aminosilane (solid content: 100% by mass, SH6020, manufactured by Dow Corning Toray | 1.0 part by mass |
| Toluene | 60 parts by mass |
| Butyl cellosolve | 60 parts by mass |

The materials for the carrier were dispersed with a homomixer for 10 min to obtain a solution for forming a coating film of the acrylic resin and the silicone resin containing the alumina particles. The solution for forming a coating film was applied onto the surface of fired ferrite powder [$(MgO)_{1.8}(MnO)_{49.5}(Fe_2O_3)_{48.0}$, average particle diameter: 25 μm] serving as a core material, so as to have a thickness of 0.15 μm with SPILA COATER (manufactured by OKADA SEIKO CO., LTD.), followed by drying, to thereby obtain coated ferrite powder. The coated ferrite powder was allowed to stand in an electric furnace at 150° C. for one hour for firing. After cooling, the ferrite powder bulk was disintegrated with a sieve with an opening of 106 μm to obtain a carrier. As to the measurement of the thickness of the binder resin film, since the coating film covering the surface of the carrier could be observed by observing the cross-section of the carrier under a transmission electron microscope, the average value of the film thickness was determined as the film thickness. Thus, Carrier A having a weight average particle diameter of 35 μm was obtained.

[Production of Two-Component Developer]

Two-Component Developers a to i were produced respectively using Toners a to i and Carrier A. Specifically, 7 parts by mass of the toner and 100 parts of the carrier were uniformly mixed using a tubular mixer including a container that was tumbled for stirring, and then charged to thereby produce the two-component developer.

The evaluation of Toners a to i were performed as described below. The results are shown in Table 2.

(Evaluation of Toner)

<Decreased Value of Charge Amount>

The charge amounts of the toner base particles before and after heat treatment for toner production were measured with the V blow-off device (manufactured by RICOH SOZO KAIHATSU K.K.), and the decrease of the charge amount of the toner base particles between before heat treatment and after heat treatment was evaluated based on the following evaluation criteria.

Decrease of charge amount=charge amount before heat treatment−charge amount after heat treatment A: less than 4 μC/g B: 4 μC/g or more and less than 8 μC/g C: 8 μC/g or more <Volume Average Particle Diameter (Dv)>

The volume average particle diameter (Dv) of the toner was measured using a particle size analyzer ("MULTISIZER III," manufactured by Beckman Coulter Inc.), and then cohesion of toner particles by heat treatment for toner production was evaluated. According to the following evaluation criteria, the cohesion of toner particles was evaluated based on an absolute value of the variation from a desired volume average particle diameter (Dv) (5.2 μm±0.3 μm).

A: less than 0.3 μm

B: 0.3 μm or more and less than 0.5 μm

C: 0.5 μm or more

<BET Specific Surface Area>

The BET specific surface area of the toner was measured with an automatic specific surface area/pore distribution measuring device TRISTAR 3000 (manufactured by SHIMADZU CORPORATION), and the surface properties of the toner particles, which had been subjected to heat treatment for toner production was evaluated. The surface properties of the toner particles were evaluated based on the absolute value of the variation from a desired BET specific surface area (1.6 $m^2/g$±0.4 $m^2/g$), according to the following evaluation criteria.

A: less than 0.4 $m^2/g$

B: 0.4 $m^2/g$ or more and less than 0.6 $m^2/g$

C: 0.6 $m^2/g$ or more

TABLE 2

| | Toner | Decreased value of charge amount | Toner quality: Volume average particle diameter | Toner quality: BET specific surface area |
|---|---|---|---|---|
| Ex. 1 | a | A | A | A |
| Ex. 2 | b | A | A | A |
| Ex. 3 | c | A | A | A |
| Ex. 4 | d | A | A | A |
| Ex. 5 | e | A | A | A |
| Ex. 6 | f | B | A | A |
| Ex. 7 | g | A | A | A |
| Comp. Ex. 1 | h | C | C | A |
| Comp. Ex. 2 | i | C | B | A |

When the increase of the electric conductivity after the heat treatment was 50 μS/cm or less, the decrease of the charge amount was small, and excellent results were obtained. When the increase of the electric conductivity after the heat treatment was more than 50 μS/cm, the decrease of the charge amount was large.

As will be appreciated from the results, by using the toner of the present invention, in a high-speed full color image forming method, transfer efficiency is improved, no image defect occurs during transfer, and images having excellent reproducibility can be formed for a long period of time, thus the toner of the present invention can be suitably used in an electrophotographic image forming apparatus performing two transfer steps including a primary transfer from an electrophotographic photoconductor to an intermediate transfer medium and a secondary transfer from the intermediate transfer medium to a recording medium on which a final image is formed.

What is claimed is:

1. A method for producing a toner, comprising dispersing toner particles comprising at least a binder resin in a first aqueous medium so as to produce an aqueous dispersion; and subjecting the aqueous dispersion to heat treatment, wherein the heat treatment results in the electric conductivity of the aqueous dispersion after the heat treatment being higher than the electric conductivity of the aqueous dispersion before the heat treatment by 50 μS/cm or less.

2. The method for producing a toner according to claim 1, wherein the dispersing toner particles comprises decreasing the electric conductivity of the aqueous dispersion to 30 μS/cm or less.

3. The method for producing a toner according to claim 1, wherein the heat treatment is performed to the aqueous dispersion at a temperature in a range of from (Tg of the toner −10° C.) to (Tg of the toner +10° C.).

4. The method for producing a toner according to claim 1, wherein the heat treatment is performed to the aqueous dispersion for 1 minute to 180 minutes with stirring.

5. The method for producing a toner according to claim 1, wherein the heat treatment is a treatment to give the aqueous dispersion a concentration of an ionic material contained therein after the heat treatment that is higher than the concentration of the ionic material contained in the aqueous dispersion before the heat treatment by 40 ppm or less.

6. The method for producing a toner according to claim 1, wherein the toner particles are obtained by emulsifying or dispersing an organic solvent solution of a toner material in a second aqueous medium, so as to produce an emulsification or dispersion liquid, and removing the organic solvent from the emulsification or dispersion liquid, wherein the toner material at least comprises the binder resin or a binder resin precursor, and a colorant, and is dissolved or dispersed in the organic solvent, so as to form the organic solvent solution of the toner material.

7. The method for producing a toner according to claim 6, wherein the second aqueous medium comprises fine anionic resin particles having an average particle diameter of 5 nm to 50 nm and an anionic surfactant.

* * * * *